US007629949B2

(12) United States Patent
Yang

(10) Patent No.: US 7,629,949 B2
(45) Date of Patent: Dec. 8, 2009

(54) SINGLE-SIDED DRIVER USED WITH A DISPLAY PANEL AND METHOD OF DESIGNING THE SAME

(75) Inventor: Joon-hyun Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 718 days.

(21) Appl. No.: 10/826,278

(22) Filed: Apr. 19, 2004

(65) Prior Publication Data

US 2004/0257308 A1 Dec. 23, 2004

(30) Foreign Application Priority Data

Jun. 20, 2003 (KR) ..... 10-2003-0040099

(51) Int. Cl.
*G09G 3/28* (2006.01)

(52) U.S. Cl. ..... 345/63; 345/60; 315/169.4

(58) Field of Classification Search ..... 345/60, 345/61, 62, 66, 68, 204, 63; 313/582; 315/169.1, 315/169.4

See application file for complete search history.

(56) References Cited

U.S. PATENT DOCUMENTS

| | | | | |
|---|---|---|---|---|
| 6,853,144 | B2 * | 2/2005 | Marcotte | 315/169.1 |
| 6,906,706 | B2 * | 6/2005 | Kosaka et al. | 345/211 |
| 7,081,891 | B2 * | 7/2006 | Schermerhorn | 345/211 |
| 7,190,337 | B2 * | 3/2007 | Miller et al. | 345/87 |
| 2002/0000955 | A1 * | 1/2002 | Derksen et al. | 345/60 |
| 2003/0057851 | A1 | 3/2003 | Roh et al. | |
| 2003/0071768 | A1 | 4/2003 | Park | |
| 2003/0080925 | A1 | 5/2003 | Lee | |

FOREIGN PATENT DOCUMENTS

| | | | |
|---|---|---|---|
| JP | 11-15426 | | 1/1999 |
| JP | 11-231829 | * | 8/1999 |

OTHER PUBLICATIONS

European Search Report dated Feb. 8, 2008 issued in EP 04102731.9. Chung-Wook Roh, Sang-Hoon Lee, Hye-Jeong Kim and Chang-Wan Hong—Dept. of DTV Core Technology, Samsung Electronics Co., Ltd., Suwon City, Korea; Myung-Joong Youn—Dept. of Electrical & Computer Engineering, Kaist, Daejeon City, Korea—(P-19: Multi-Level Voltage—Fed Power Efficient Sustain Circuit for AC Plasma Display Panel Drive).

* cited by examiner

*Primary Examiner*—Abbas I Abdulselam
(74) *Attorney, Agent, or Firm*—Stanzione & Kim LLP

(57) ABSTRACT

A single-sided driver used with a display panel and a method of designing the same. The single-sided driver used with a display panel includes a single-sided driver circuit having predetermined circuit elements including energy accumulation elements and switching elements, and establishes current flow paths to generate predetermined driving voltage waveforms required for both X and Y axes electrodes, according to predetermined switching sequences to drive the display panel.

25 Claims, 18 Drawing Sheets

SINGLE-SIDED DRIVER USED WITH A DISPLAY PANEL AND METHOD OF DESIGNING THE SAME

CROSS-REFERENCE TO RELATED APPLICATIONS

This application claims the priority of Korean Patent Application No. 2003-40099, filed on Jun. 20, 2003, in the Korean Intellectual Property Office, the disclosure of which is incorporated herein in its entirety by reference.

BACKGROUND OF THE INVENTION

1. Field of the Invention

The present invention relates to a driver used with a display panel and a method of designing the same, and more particularly, to a single-sided driver used with a display panel and a method of designing the same, in which a single-sided panel driver circuit generates driving voltages required for both X and Y axes electrodes of the display panel.

2. Description of the Related Art

A plasma display panel (PDP) is a next-generation flat panel display device that uses plasma generated by gas discharging to display text or images. In a PDP, several hundreds of thousands to several millions of pixels, depending on the size of the PDP, are arranged in the form of matrices.

FIG. 1 is a schematic diagram of a conventional alternating current (AC)-PDP sustain discharge circuit disclosed in U.S. Pat. No. 4,866,349 to Webber, et al., issued Sep. 12, 1989. In the disclosure of the AC-PDP, it is assumed that a display panel is a kind of load having a panel capacitance Cp. The basic operation of a PDP driver circuit is set forth in the above patent to Webber, et al.

Sequences for driving the PDP are divided into a reset period, an address period, and a sustain period. The reset period is for eliminating a record of a display by discharging all cells as well as eliminating wall charges. The address period is for selecting cells to be discharged, and establishing address discharging in those cells, using combinations of row/column electrodes of the panel. The sustain period is for displaying images by repeatedly sustaining discharging and recovering energy only at cells that establish wall charges by the address discharging.

In the conventional art, in order to display images on the PDP, switching operations are determined based on an address display separation (ADS) method. In the PDP of FIG. 1, switches Ys, Yg, Xs, and Xg are used as sustain switches for applying high-frequency AC pulsed-voltage to the panel during the sustain period of the PDP, and switch pairs (Ys, Xg) and (Xs, Yg) are repeatedly turned on/off in turn during the sustain period. Switches Yr, Yf, Xr, and Xf are used in an energy recovery circuit to reduce energy consumption by preventing a rapid change in panel voltage and capacitive displacement current during the sustain period. Inductors Lx and Ly are used for energy recovery. Capacitors C_Yerc and C_Xerc and diodes D_Yr, D_Xf, D_Xr, D_Yf, D_YvsC and D_YGC are passive elements, which are required for the existing energy recovery circuit proposed by Webber, et al. Typically, a circuit containing the sustain switches, the energy recovery switches, and the passive elements all together is called a sustain driver circuit. The sustain driver circuit works in the sustain period of the PDP according to the ADS method. A switch Yp is used to separate a circuit operation for the sustain discharge period from other circuit operations, e.g., circuit operations for the address period and the reset period. Switches Yrr, Yfr and Xrr are used to supply a high ramp voltage to the panel during the reset period, and work with capacitors Cset and C_Xsink to supply voltage that is greater than a source voltage, during the reset period. Switches Ysc and Ysp are used during the address period in the ADS method. In the address period, the switch Ysp is turned on and the switch Ysc is turned off, and in other periods (the reset and sustain periods) their states are reversed. For the address period, a scan driver IC 100 consisting of a shift register and voltage buffers operates to supply a horizontal synchronous signal to the PDP screen, and during other periods, the scan driver IC 100 is shorted-circuited. The specific operation of the conventional PDP driver circuit according to switching order is set forth in the U.S. Pat. No. 4,866,349.

However, the conventional PDP driver system described above with reference to FIG. 1 has to use separate panel drivers for X-axis and for Y-axis electrodes of the PDP. Accordingly, a significant number of components are required, thereby increasing the manufacturing cost and the size of the PDP driver system.

SUMMARY OF THE INVENTION

The present invention provides a single-sided driver used with a display panel and a method of designing the same, in which the single-sided driver generates driving voltages that are required for both X and Y axes electrodes.

Additional aspects and advantages of the invention will be set forth in part in the description which follows and, in part, will be obvious from the description, or may be learned by practice of the invention.

The foregoing and/or other aspects of the present invention are achieved by providing a single-sided driver used with a display panel, the single-sided driver comprising a single-sided driver circuit having predetermined circuit elements including energy accumulation elements and switching elements, and establishing current flow paths to generate predetermined driving voltage waveforms required for both X and Y axes electrodes, according to predetermined switching sequences to drive the display panel.

In an aspect of this embodiment, the single-sided driver circuit is designed to repeatedly supply zero voltage and +/− multi-level voltages that are symmetric with respect to the zero voltage (0V), across the X and Y axes electrodes of the display panel, during a sustain discharge period.

In another aspect of this embodiment, a source voltage to be supplied to the single-sided driver circuit is set to be twice as much as a voltage that is supplied to the display panel during a gas discharge mode in the sustain discharge period.

In another aspect of this embodiment, the single-sided driver circuit comprises: an isolation and reset circuit which isolates an energy recovery path and establishes a current flow path to generate reset voltage waveforms that are supplied to both the X and Y axes electrodes, so as to eliminate wall charges in the display panel, during a reset period; a scan pulse generation circuit which establishes a current flow path to generate address discharging voltage waveforms to be supplied to the X and Y axes electrodes so as to generate wall charges in the display panel during an address period; a sustain driver circuit which establishes charging/discharging paths to charge/discharge the display panel according to the predetermined switching sequences to drive the display panel during a sustain discharge period, and establishes a current flow path to generate the reset voltage waveform and the address discharging voltage waveforms during the reset period and an address period, respectively, in combination with the isolation and reset circuit and the scan pulse generation circuit.

In yet another aspect of this embodiment, the sustain driver circuit comprises a capacitor with greater capacitance than the display panel on the charging/discharging path.

In yet another aspect of this embodiment, the capacitor is set to be charged with a voltage supplied to the display panel during a gas discharge mode in the sustain discharge period.

In yet another aspect of this embodiment, the sustain driver circuit further comprises an energy recovery circuit which recovers energy discharged from the display panel by way of an LC resonant circuit, and dispatches the recovered energy back to the display panel.

In yet another aspect of this embodiment, the sustain driver circuit is designed to have a capacitor clamp-type multi-level converting circuit structure.

In still another aspect of this embodiment, the capacitor clamp-type multi-level converting circuit structure is designed by: connecting a plurality of capacitors in series; connecting one end of the series of the capacitors to ground, and supplying a source voltage to the other end of the series of capacitors; and connecting switching elements to connection nodes of the capacitors, wherein the structure enables zero voltage and +/− multi-level voltages with respect to the zero voltage to be repeatedly supplied to the display panel during the sustain period, by changing current flow paths according to the predetermined switching sequences to drive the display panel.

In yet another aspect of this embodiment, the sustain driver circuit comprises: a block of energy accumulation elements in which first, second, third, and fourth capacitors CX1, CX2, CY1 and CY2 are connected in series, and an end of the series, i.e., a free end of the first capacitor CX1, is connected to ground, and the other end of the series, i.e., a free end of the fourth capacitor CY2, is connected to a source voltage for the sustain driver circuit; first and second inductors L1 and L2 which are used to accumulate energy discharged from the X and Y axes electrodes of the display panel, in combination with the block of energy accumulation elements; a first switching block connected between a connection node of the first and second capacitors CX1 and CX2, and the second inductor L2, which includes a plurality of switching elements Xr and Xf, and a plurality of diodes D3 and D4 and drives current to flow along an LC resonant circuit path via the second inductor L2 during the charge/discharge mode for the X-axis electrode of the display panel; a second switching block connected between a connection node of the third and fourth capacitors CY1 and CY2 and the first inductor L1, which includes a plurality of switching elements Yr and Yf, and a plurality of diodes D1 and D2, and drives current to flow along an LC resonant circuit path via the first inductor L1 during the charge/discharge mode for the Y-axis electrode of the display panel; a third switching block to establish a current flow path to separately generate predetermined voltage waveforms that are required for the X and Y axes electrodes of the display panel according to the predetermined switching sequences to drive the display panel, by connecting a first and second switching elements XL and XH, and third and fourth switching elements YL and YH in series, respectively, locating a diode DX between the second and third switching elements XH and YL, connecting a free end of the first switching element XL to ground, and connecting a free end of the fourth switching element YH to the source voltage for the sustain driver circuit, connecting a connection node of the first and second switching elements XL and XH to the second inductor L2 and the X-axis electrode of the display panel, connecting a connection node of the third and fourth switching elements YL and YH to the first inductor L1, and connecting a connection node of the second and third capacitors CX2 and CY1 to a connection node of the diode DX and the third switching element YL; and a capacitor CSTG which is located between the connection node of the third and fourth switching elements YL and YH and the isolation and reset circuit.

In yet another aspect of this embodiment, the isolation and reset circuit comprises an isolation circuit which includes a diode $D_Y$ and a switching element $Y_P$, connected between the sustain driver circuit and the scan pulse generation circuit, so as to isolate the scan pulse generation circuit from the energy recovery circuit included in the sustain driver circuit during the reset period, according to a predetermined reset switching sequence; and a reset circuit which is used to separately generate reset voltage waveforms for the X and Y axes electrodes according to the predetermined switching sequences to drive the display panel by connecting a switching element $Y_{fr}$ between a connection node of the scan pulse generation circuit and the isolation circuit, and the ground, connecting a diode $D_5$ and a switching element $Y_{rr}$ in series between the connection node of the scan pulse generation circuit and the isolation circuit and a first reset source voltage, and connecting a switching element $X_e$ between the X-axis electrode and a second reset source voltage.

The foregoing and/or other aspects of the present invention are also achieved by providing a method of designing a single-sided driver circuit to drive a display panel, the method comprising: constructing the single-sided driver circuit including predetermined circuit elements having energy accumulation elements and switching elements, wherein the circuit elements are arranged so as to establish current flow paths to generate predetermined driver voltage waveforms that are required for X and Y axes electrodes of the display panel according to predetermined switching sequences to drive the display panel.

In an aspect of this embodiment, the circuit elements are arranged so as to supply zero voltage and +/− multi-level voltages that are symmetric with respect to the zero voltage to the display panel during a sustain discharge period, in the predetermined switching sequences to drive the display panel.

In another aspect of this embodiment, a voltage to be supplied to the single-sided driver circuit is set to be twice as much as a voltage to be supplied to the display panel during a gas discharging mode in a sustain discharge period.

In yet another aspect of this embodiment, the single-sided driver circuit is designed to have a capacitor clamp-type multi-level converting circuit structure.

In yet another aspect of this embodiment, the capacitor clamp-type multi-level converting circuit structure is designed by: connecting a plurality of capacitors in series; connecting the series of the capacitors between ground and a source voltage to be supplied to a sustain driver circuit; connecting each of connection nodes of the capacitors to each of switching elements; and repeatedly supplying zero voltage, and +/− multi-level voltages that are symmetric with respect to the zero voltage, to the display panel during a sustain discharge period, by changing current flow paths according to the predetermined switching sequences to drive the display panel.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
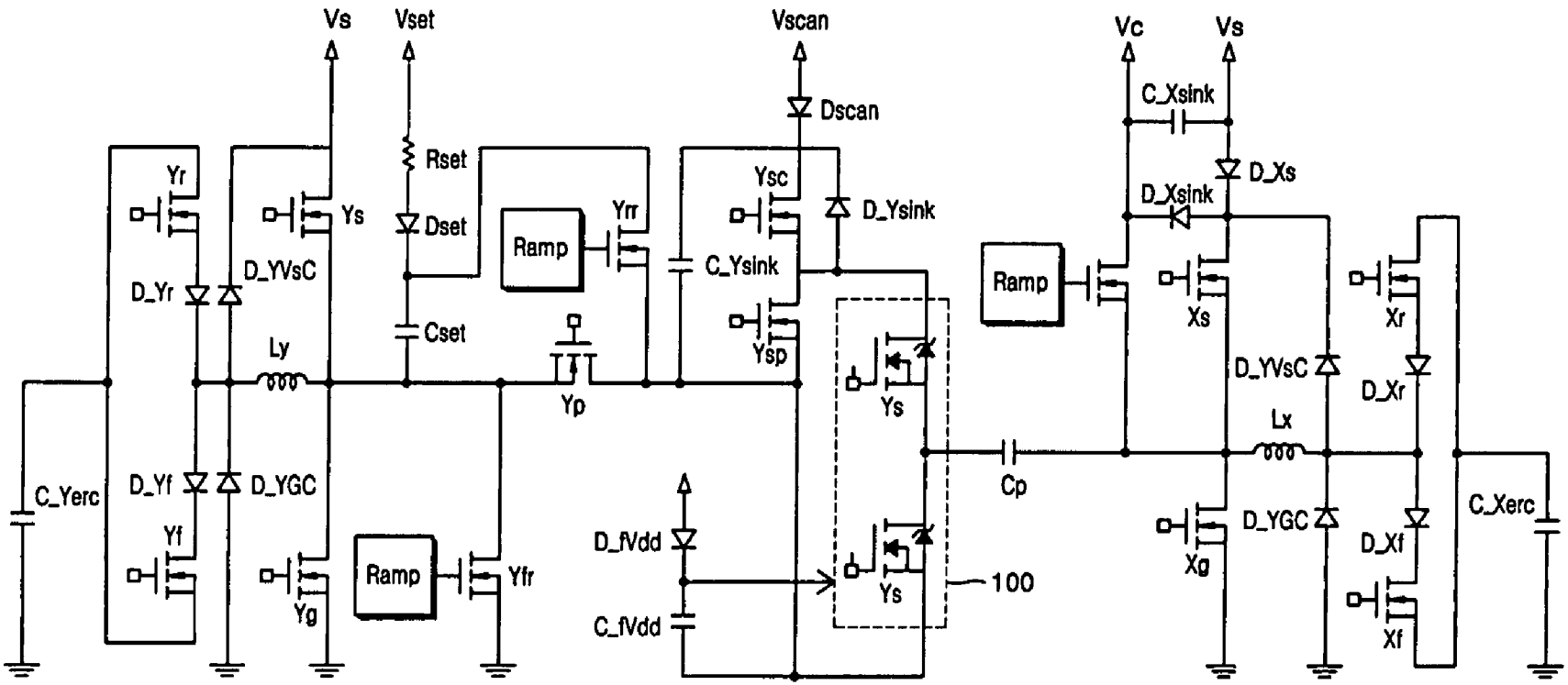
FIG. 1 (PRIOR ART)
FIG. 1 is a schematic diagram of a conventional plasma display panel driver system.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
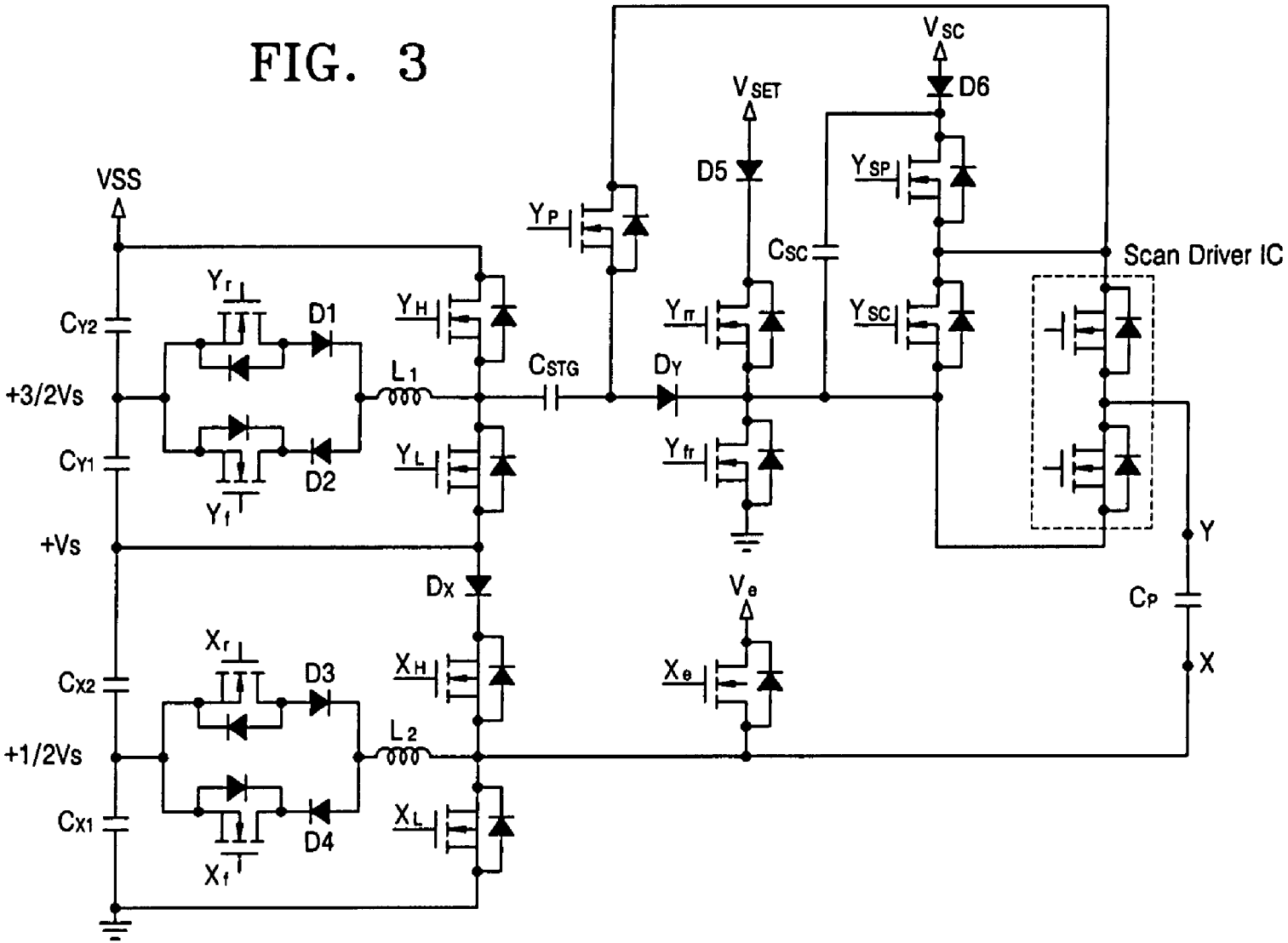
FIG. 3 is a schematic diagram of a single-sided driver in a display panel driver system according to an embodiment of the present invention.

FIG. 3 is a schematic diagram of a single-sided driver in a display panel driver system according to an embodiment of the present invention.

Referring to FIG. 3, a circuit including capacitors $C_{X1}$, $C_{X2}$, $C_{Y1}$ and $C_{Y2}$, MOSFET switches $X_r$, $X_f$, $Y_r$, and $Y_f$, inductors $L_1$ and $L_2$, and diodes $D_1$ to $D_4$, is called an energy recovery circuit, in which the diodes $D_1$ to $D_4$ prevent reverse current flowing through body diodes of the MOSFET switches. The energy recovery operation is performed by series resonance of a panel capacitor $C_p$ and the inductor $L_1$ or $L_2$, during a charge/discharge period of the panel.

A circuit including MOSFET switches $X_L$ $X_H$ $Y_L$ and $Y_H$ is called a sustain switching circuit.

In this embodiment of the present invention, a circuit including the energy recovery circuit, the sustain switching circuit and a capacitor $C_{STG}$ is called a sustain driver circuit.

A MOSFET switch $Y_p$ and a diode $D_Y$ are used to cut off a ramp voltage that is generated during a reset period from the energy recovery circuit. Accordingly, a circuit including the MOSFET switch $Y_p$ and the diode $D_Y$ is called an isolation circuit, for convenience.

A circuit including MOSFET switches $Y_{ff}$, $Y_{fr}$, and $X_e$, and a diode $D_5$, is called a reset circuit.

Finally, a circuit including a scan driver IC and MOSFET switches $Y_{SP}$ and $Y_{SC}$ is called a scan pulse generation circuit.

Designing the circuit of FIG. 3 is characterized as follows:

1. The sustain driver circuit establishes current flow paths to repeatedly supply zero voltage (0V), and $+V_S$ and $-V_S$ voltages that are symmetric with respect to 0V, across X and Y axes electrodes during a sustain discharge period.

2. A source voltage to be supplied to the single-sided driver circuit according to the present invention is set to twice as much as $V_S$ that is supplied to the display panel in a gas discharge mode during the sustain discharge period. That is, the source voltage is set to $2V_S$.

3. The single-sided driver circuit according to FIG. 3 comprises an isolation and reset circuit combination that establishes a current flow path to generate reset ramp voltage waveforms for X and Y axes electrodes, so as to eliminate wall charges on the display panel while cutting off the energy recovery path during a reset period. The single-sided driver circuit also comprises a scan pulse generation circuit that establishes a current flow path to generate voltage waveforms for X and Y axes electrodes, so as to make wall charges on the display panel during an address period. The single-driver circuit also comprises a sustain driver circuit that establishes charging/discharging paths to charge/discharge the display panel according to predetermined switching sequences to drive the display panel during the sustain discharge period, and establishes predetermined current flow paths to generate a reset voltage waveform and an address discharge voltage waveform in combination with the reset circuit and the scan pulse generation circuit, respectively, during the reset period and the address period.

4. The sustain driver circuit according to FIG. 3 includes a capacitor $C_{STG}$ that has a larger capacitance than the display panel on the charging/discharging path. The capacitor $C_{STG}$ is designed to be charged with the voltage $V_S$ that is applied to the display panel in the gas discharging mode during the sustain discharge period before a sustain discharge period.

5. The sustain driver circuit according to FIG. 3 is designed to have the structure of a capacitor clamp-type multi-level converting circuit. The structure of the capacitor clamp-type multi-level converting circuit may be efficiently realized by connecting a plurality of capacitors in series, connecting one end of the series of the capacitors to ground, and connecting the other end of the series to the source voltage to be supplied to the sustain driver circuit, connecting each of connection nodes of the capacitors to each of a plurality of switching elements, and changing the current flow paths according to a predetermined display panel switching sequence, so that 0 voltage (0V), and +/− multi level voltages that are symmetric with respect to 0V are repeatedly supplied to the display panel during the sustain discharge period.

6. The sustain driver circuit according to FIG. 3 includes a block of energy accumulation elements having first through fourth capacitors $C_{X1}$, $C_{X2}$, $C_{Y1}$ and $C_{Y2}$ that are connected in series, where one end of the series (one end of the first capacitor $C_{X1}$) is connected to ground and the other end of the series (one end of the fourth capacitor $C_{Y2}$) is connected to a source voltage to be supplied to the sustain driver circuit. The sustain driver circuit also includes first and second inductors $L_1$ and $L_2$ that accumulate energy discharged from the X and Y axes electrodes of the display panel in combination with the energy accumulation block, and a first switching block located between a connection node of the first and second capacitors $C_{X1}$ and $C_{X2}$, and the second inductor $L_2$. The first switching block includes a plurality of switching elements $X_r$ and $X_f$, and a plurality of diodes $D_3$ and $D_4$, the switching elements $X_r$ and $X_f$ switching a current flow to establish an L-C resonant path via the second inductor $L_2$ in a charge/discharge mode for the X-axis electrode of the display panel. The sustain driver circuit also includes a second switching block located between a connection node of the third and fourth capacitors $C_{Y1}$ and $C_{Y2}$, and the first inductor $L_1$, the second switching block including a plurality of switching elements $Y_r$ and $Y_f$ and a plurality of diodes $D_1$ and $D_2$, the switching elements $Y_r$ and $Y_f$ switching a current flow to establish an L-C resonant path via the first inductor $L_1$ in a charge/discharge mode for the Y axis electrode of the display panel. The sustain driver circuit also includes a third switching block which establishes a current flow path to separately generate predetermined voltage waveforms that are required to drive the X and Y axes electrodes of the display panel according to predetermined switching sequences to drive the display panel. The third switching block establishes the current flow path by connecting first and second switching elements, $X_L$ and $X_H$, and third and fourth switching elements $Y_L$ and $Y_H$, in series, respectively, locating a diode $D_X$ between the second and the third switching elements $X_H$ and $Y_L$, connecting an end of the first switching element $X_L$ to ground and the other end of the fourth switching element $Y_H$ to the source voltage to be supplied to the sustain driver circuit, connecting a connection node of the first and second switching elements $X_L$ and $X_H$ to the second inductor $L_2$ and the X axis electrode of the display panel, connecting a connection node of the third and fourth switching elements $Y_L$ and $Y_H$ to the first inductor $L_1$, and connecting the connection node of the second and third capacitors $C_{X2}$ and $C_{Y1}$ to another connection node of the diode $D_X$ and the third switching element $Y_L$. Finally the sustain driver circuit includes a capacitor $C_{STG}$ that is connected between the connection node of the third and fourth switching elements $Y_L$ and $Y_H$, and the isolation and reset circuit.

7. The isolation circuit according to the present invention includes a diode $D_Y$ and a switching element $Y_P$, which are located between the sustain driver circuit and the scan pulse generation circuit, to cut off the scan pulse generation circuit from the energy recovery circuit that is contained in the sustain driver circuit, according to a predetermined reset switching sequence, during the reset period.

The reset circuit separately generates reset voltage waveforms for the X and Y axes electrodes according to the switching sequences to drive the display panel, by connecting a switching element $Y_{fr}$ between a connection node of the scan pulse generation circuit and the isolation circuit, and the ground, connecting a diode $D_5$ and a switching element $Y_{rr}$ in series between the connection node of the scan pulse generation circuit and the isolation circuit, and a first reset voltage source $V_{SET}$, and connecting a switching element $X_e$ between the X axis electrode and a second reset voltage source $V_e$.

Figure 2:
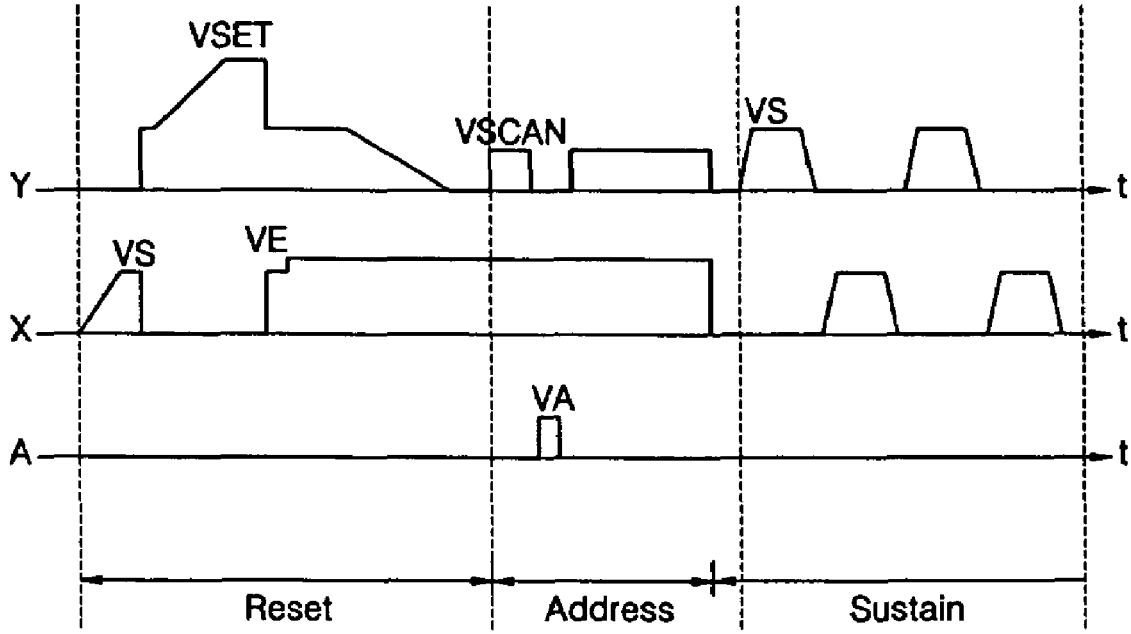
FIG. 2 (PRIOR ART)
FIG. 2 is a diagram of voltage waveforms applied to an X-axis electrode, a Y-axis electrode, and an address electrode of a panel for a reset period, an address period, and a sustain period, all of which are required for a conventional plasma display panel driver system.

FIG. 2 shows diagrams of voltage waveforms that are required for the X and Y axes electrodes during an entire gas discharge period, according to the ADS driving method. Since voltage waveforms for the electrodes during a sustain period are continuous square voltage waveforms, an equivalent circuit without the isolation circuit, reset circuit and scan pulse generation circuit, will be used to describe operations in different modes.

The following assumptions are made in analyzing circuit operations:

1. Before the sustain discharge period, the capacitor $C_{STG}$ has been charged with voltage $+V_S$ in advance. One way of charging the capacitor $C_{STG}$ with the voltage $+V_S$ is to use a separate charging circuit (not shown). Even without the separate charging circuit, a square voltage of $+2V_S$ with a 50% duty rate is supplied to the capacitor $C_{STG}$ during the sustain period, so that the capacitor $C_{STG}$ can naturally be charged with $+V_S$ after several frames.

2. All of the energy MOSFET switches are ideal with "0" switching loss.

3. All of the capacitors $C_{X1}$, $C_{X2}$, $C_{Y1}$ and $C_{Y2}$ have the same capacitance.

4. The capacitance of each of the capacitors $C_{X1}$, $C_{X2}$, $C_{Y1}$, $C_{Y2}$ and $C_{CTG}$ is much greater than that of the panel capacitor $C_P$.

5. Voltages across the capacitors $C_{X1}$, $C_{X2}$, $C_{Y1}$ and $C_{Y2}$ are the same and equal to $+V_S/2$.

Figure 4:
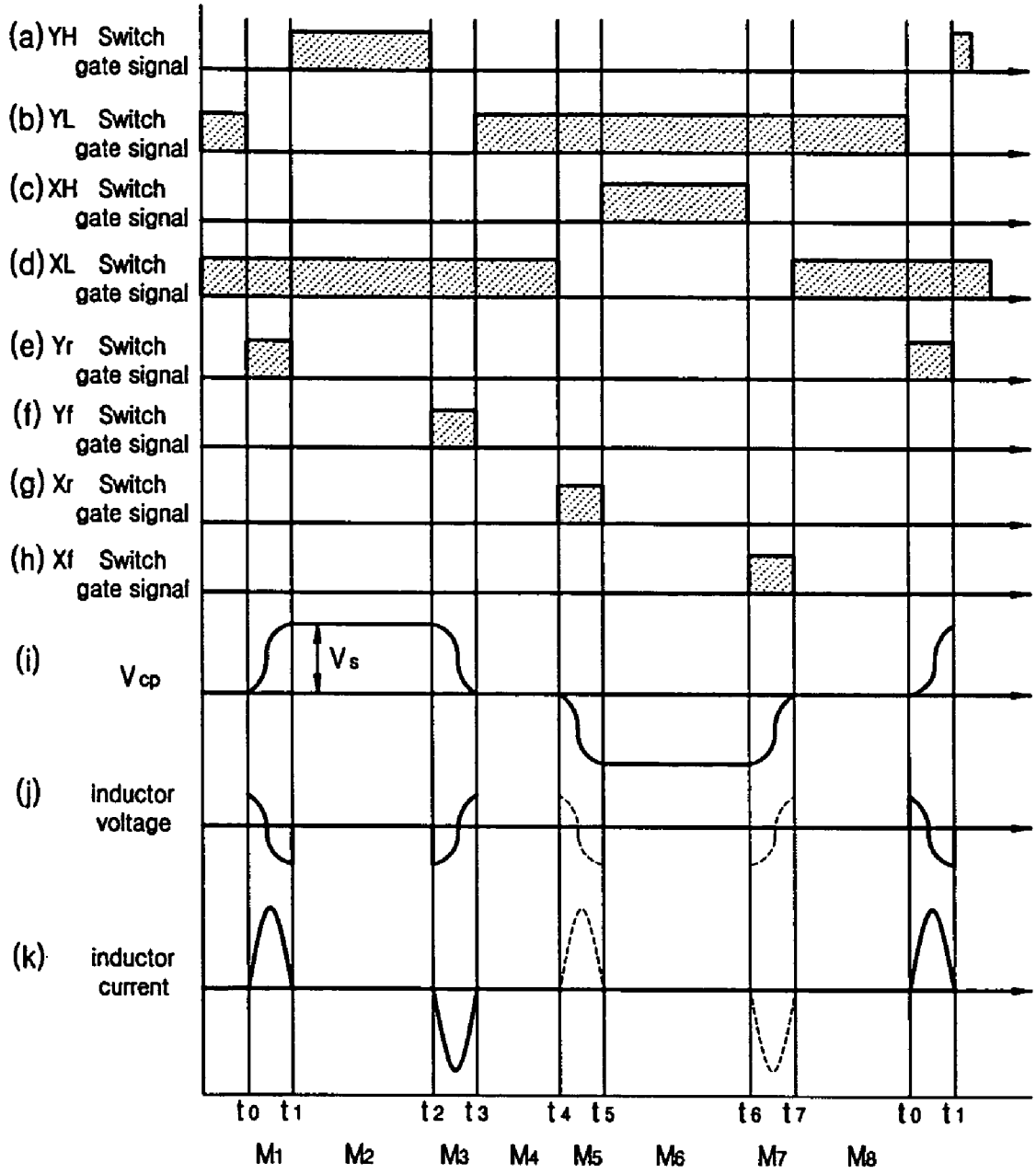
FIG. 4 is a waveform diagram of major voltages/currents according to switching sequences used with a driving display panel according to FIG. 3.

Applying the above assumptions, the AC-PDP sustain discharge period can be divided into the following 8 modes according to switching sequences during the sustain discharge period. The modes will be described with reference to FIGS. 5A through 5H showing switching sequences in the following modes 1 through 8 in accordance with FIG. 4.

$$\text{mode 1}(t_0 \leqq t < t_1;\ \text{pre-charge mode}). \tag{1}$$

Since switching elements $Y_L$ and $X_L$ have been turned on before $t_0$, the voltage across the panel capacitor $C_P$ stays at 0V. Voltages across the drain-source of the switching elements $Y_H$ and $X_H$ are the same, and equal to $+V_S$.

Figure 5A:
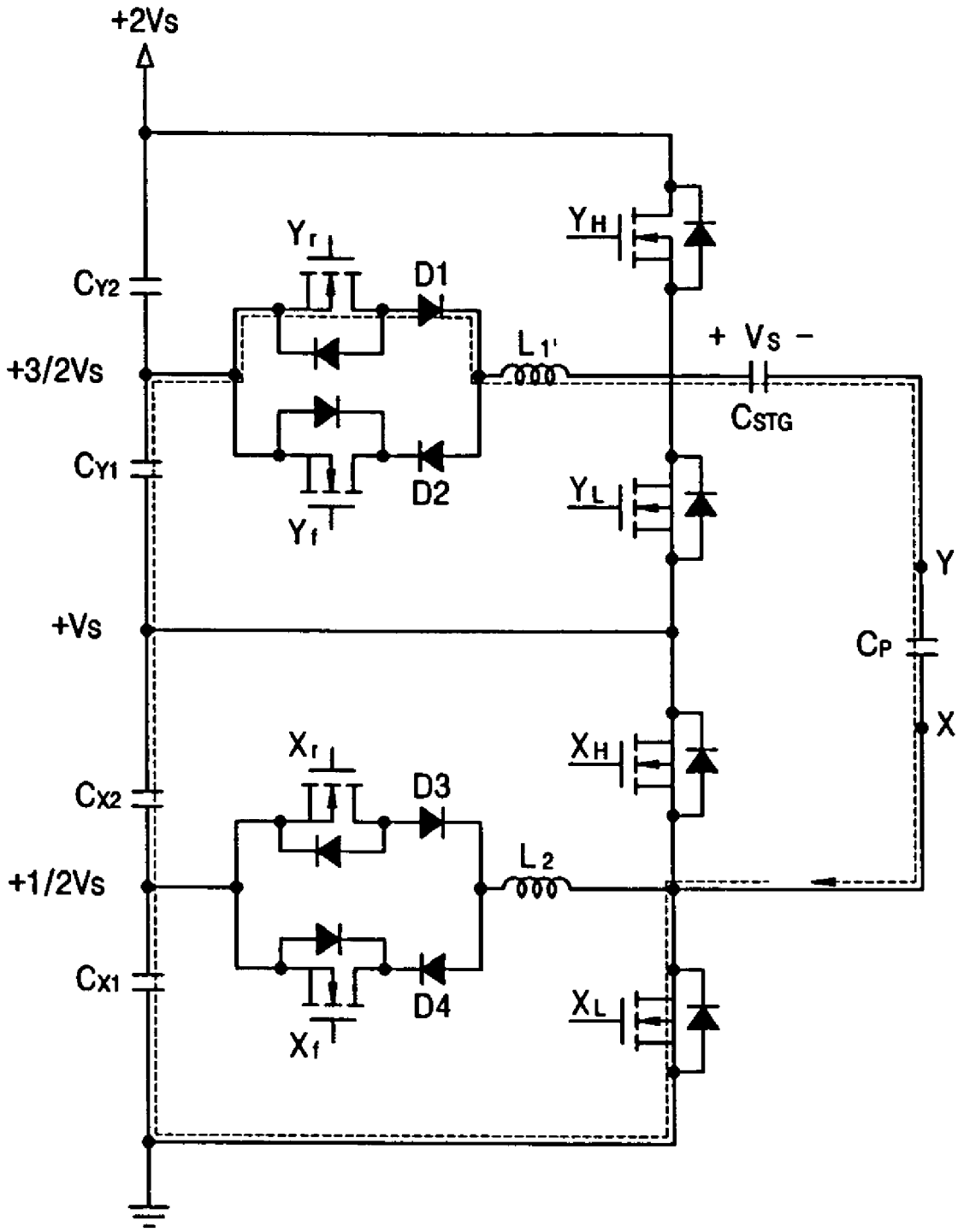
FIGS. 5A through 5H show current flow paths of the single-sided driver circuit of FIG. 3, in modes 1 to 8 in a sustain discharge period according to switching sequences to drive a display panel.

At $t=t_0$, the switching element $Y_L$ is turned off and $Y_r$ is turned on. Accordingly, energy stored in the capacitors $C_{X1}$, $C_{X2}$, and $C_{Y1}$ moves to the capacitor $C_P$ through a resonant path $C_{Y1}$-$Y_r$-$D_1$-$L_1$-$C_{STG}$-$C_P$-$X_L$ as shown in FIG. 5A. Inductor current $i_{L1}$ and the panel voltage $v_P$ can be obtained in equation 1 as follows:

$$i_{L1}(t) = \frac{V_S}{2\sqrt{L_1/C_P}}\sin\omega(t-t_0) \tag{1}$$

$$v_P(t) = \frac{V_S}{2}(1-\cos\omega(t-t_0)) \text{ where}$$

$$\omega = 1/\sqrt{L_1 C_P}.$$

The panel voltage $v_P$ and the voltage across the drain-source of the switching element $Y_H$ increase from 0V up to $+V_S$. If $Z_r=\sqrt{L_1/C_P}$, the peak value of the panel current $I_{P,PK}$ is limited to $+V_S/(2Z_r)$.

When $i_{L1}=0$ at $t=t_1$, mode 1 is finished. A period of mode 1, $T_{rY}$, can be represented by the equation 2 as follows:

$$T_{rY} = \frac{\pi}{\omega} = \pi\sqrt{L_1 C_P} \tag{2}$$

$$\text{mode 2}(t_1 \leqq t < t_2;\ \text{gas-discharge mode}). \tag{2}$$

Figure 5B:
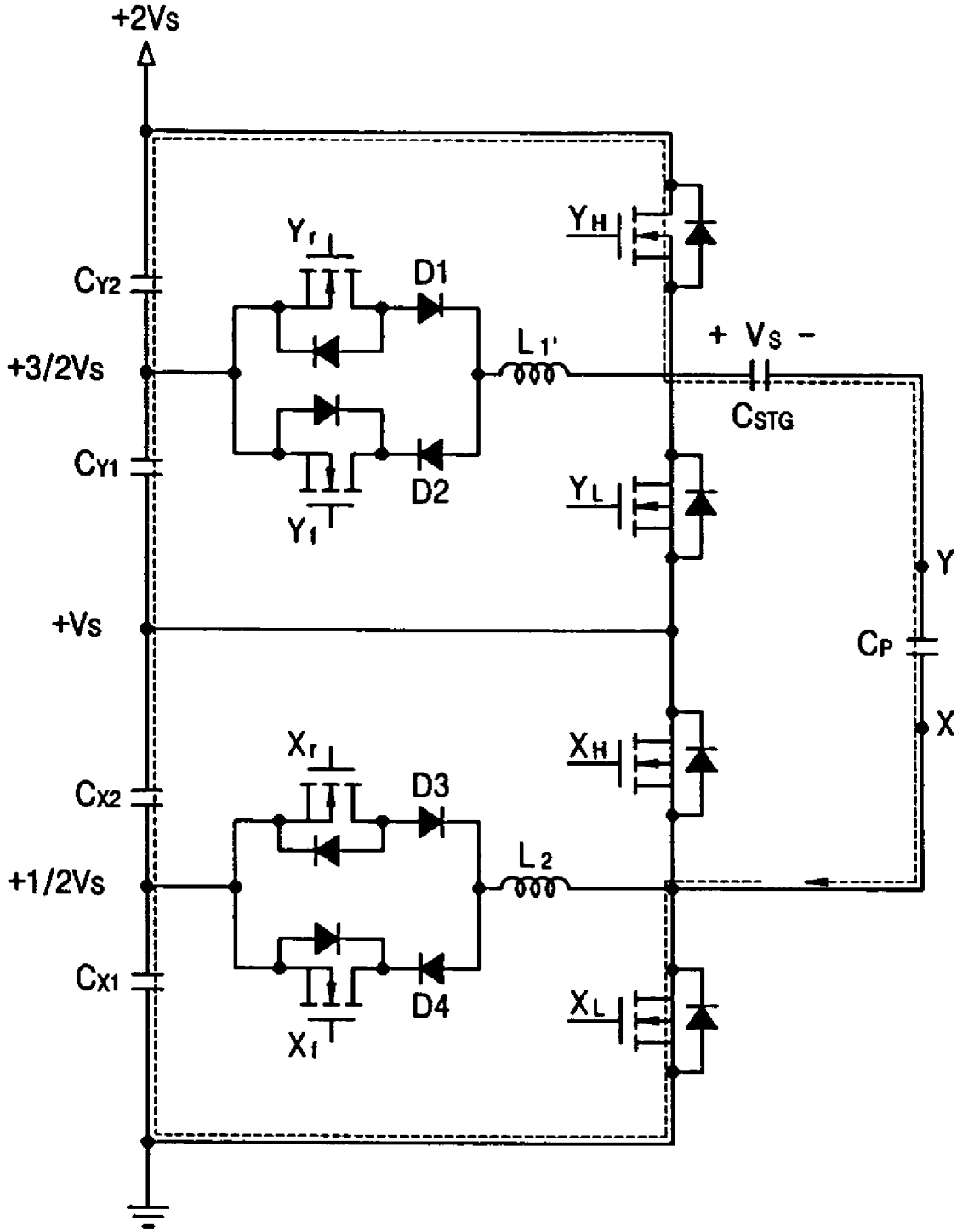

At $t=t_1$, switching elements $Y_r$ and $Y_L$ are turned off, and $Y_H$ is turned on. The voltage across $Y_L$ and $X_H$ is limited to $+V_S$. In mode 2, as shown in FIG. 5B, the panel voltage $v_P$ stays at $+V_S$, and gas discharge current flows through the panel. Though the period of mode 2 can be defined arbitrarily, it is better to set the period as short as possible because AC-PDPs need to operate at a high frequency.

$$\text{mode 3}\ (t_2 \leqq t < t_3;\ \text{pre-discharge mode}). \tag{3}$$

Figure 5C:
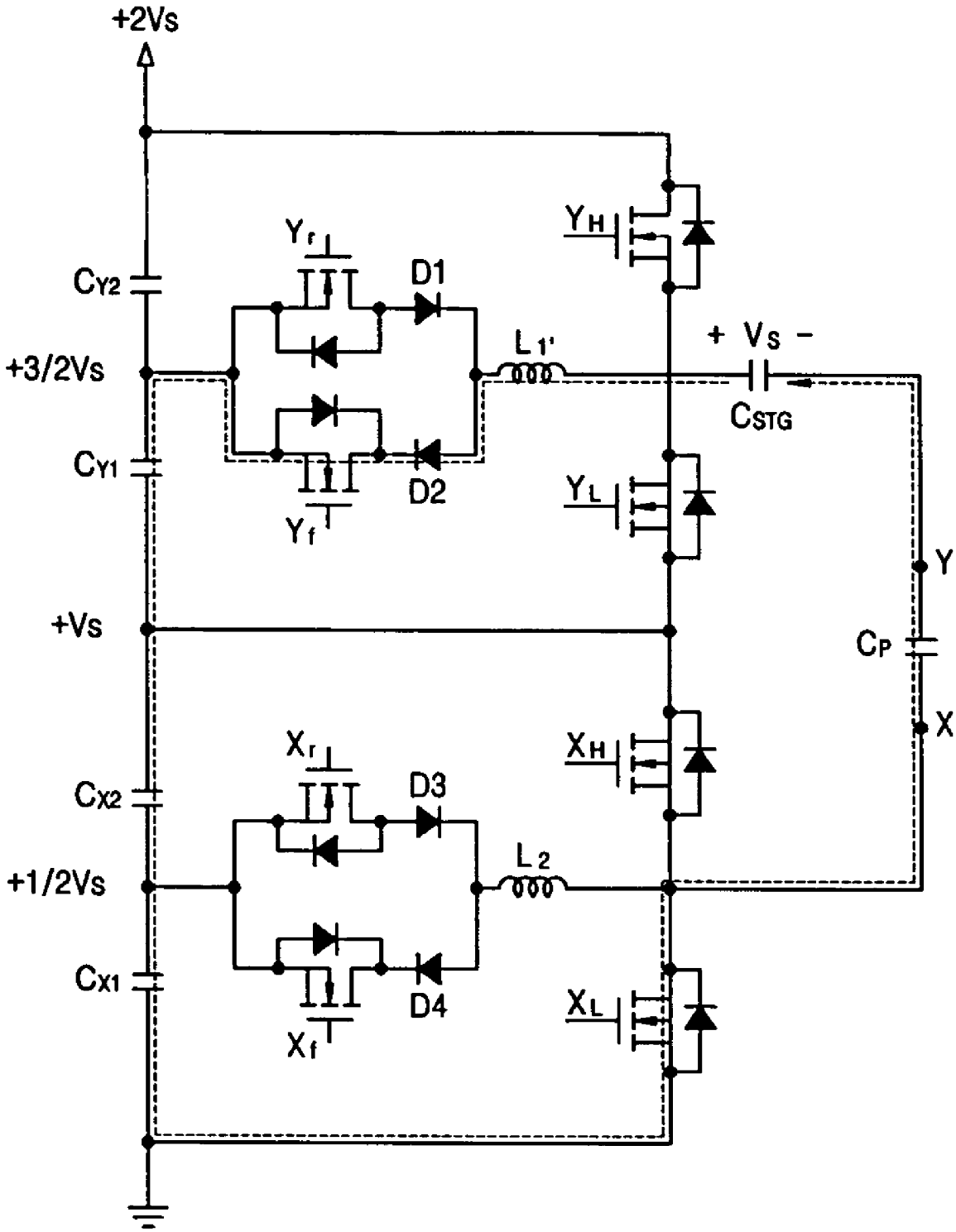

Mode 3 begins with the turning-on of switching element $Y_f$ at $t=t_2$. As shown in FIG. 5C, energy charged in the panel capacitor $C_P$ moves to the capacitors $C_{Y1}$, $C_{X2}$, and $C_{X1}$ through an L-C resonant path $X_L$-$C_P$-$C_{STG}$-$L_1$-$D_2$-$Y_f$-$C_{Y1}$. In mode 3, the inductor current $i_{L1}$ and the panel voltage $v_P$ can be calculated by the following equations 3:

$$i_{L1}(t) = \frac{V_S}{2\sqrt{L_1/C_P}}\sin\omega(t-t_2) \tag{3}$$

-continued $$v_P(t) = \frac{V_S}{2}(1 - \cos\omega(t - t_3))$$

The panel voltage $v_P$ decreases from $+V_S$ to 0, and the peak current of the panel, $I_{P,\ PK}$ is limited to $-V_S/(2Z_r)$. In mode 3, a voltage across the drain-source terminals of the switch $Y_H$ increases from 0 to $+V_S$. When $i_{L1}=0$ at $t=t_3$, mode 3 is finished. A period of mode 3, is equal to the period of mode 1, $T_{rY}$.

mode 4($t_3 \leqq t < t_4$; idle mode). (4)

Figure 5D:
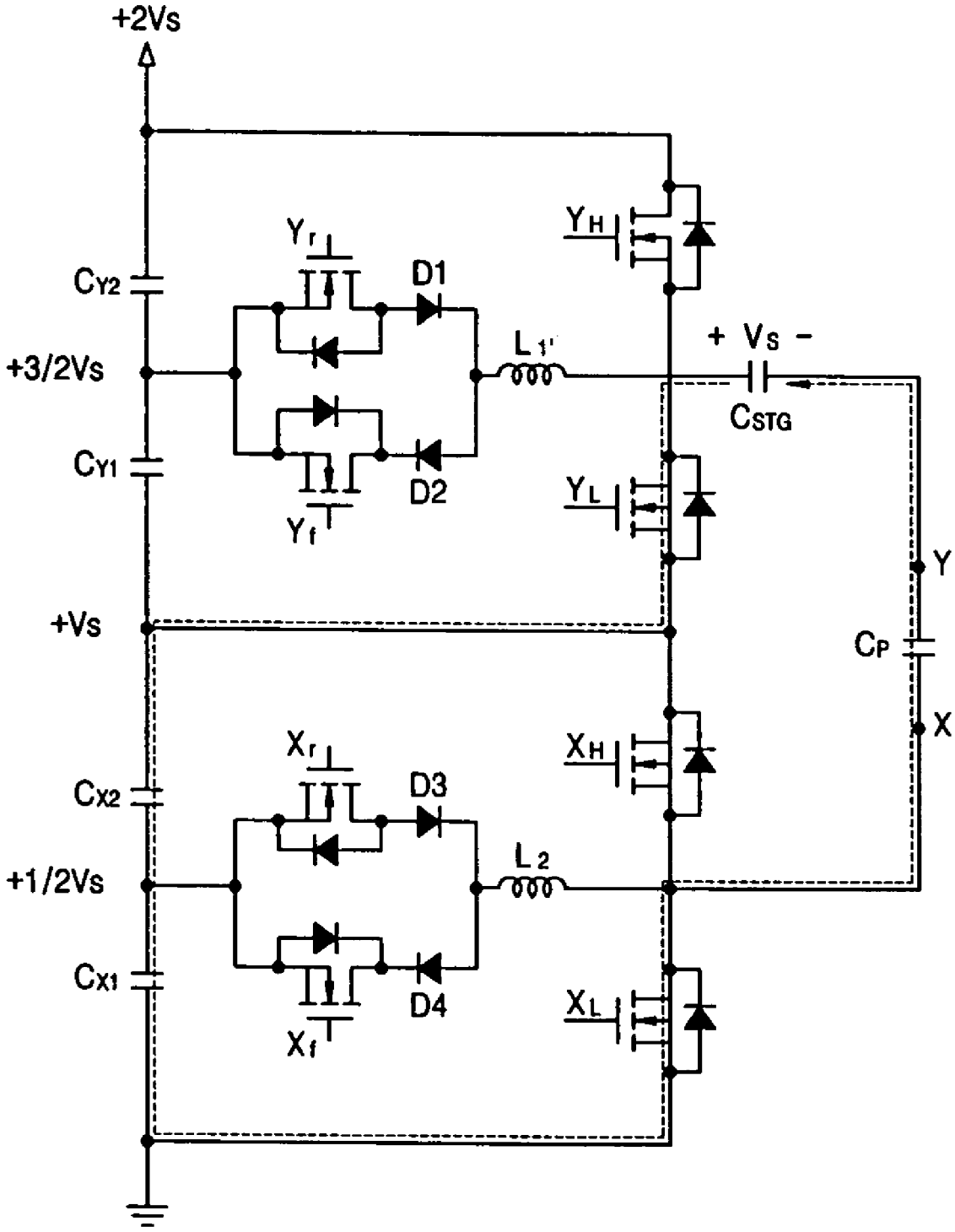

Since the switching element $Y_L$ is turned on by switching with a zero-switching-voltage, no energy is dissipated by turning-on the switching elements, in theory. In mode 4, as shown in FIG. 5D, the panel voltage $v_P$ stays at 0. This mode 4 is finished when the switching element $X_L$ is turned off and the switching element $X_r$ is turned on at $t=t_4$.

mode 5($t_4 \leqq t < t_5$; pre-charge mode). (5)

Figure 5E:
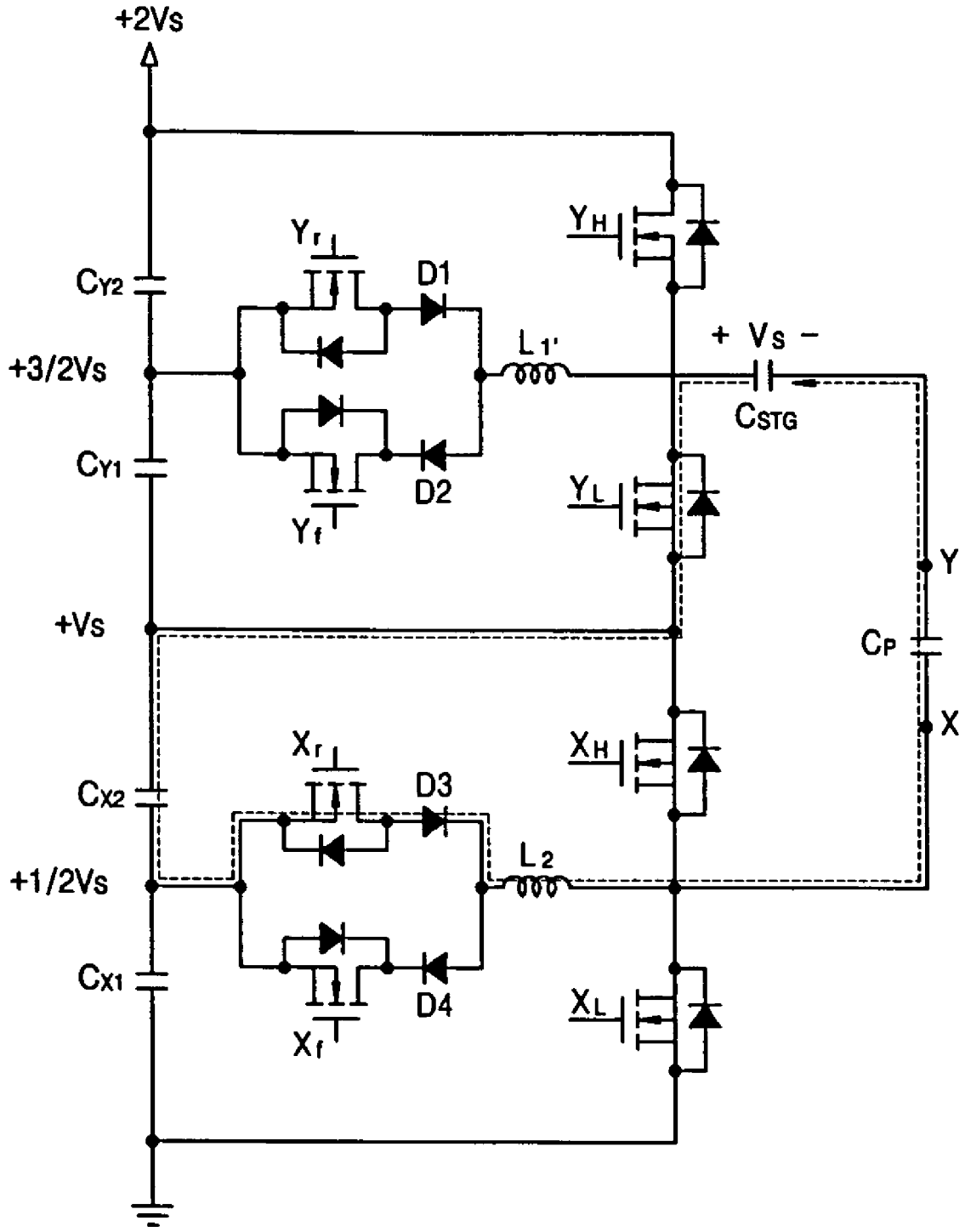

In mode 5, as shown in FIG. 5E, the energy stored in the capacitor $C_{X1}$ moves to the panel capacitor $C_P$ through a resonant path $X_r$-$D_3$-$L_2$-$C_P$-$C_{STG}$-$Y_L$-$C_{X2}$. The inductor current $i_{L2}$ and the panel voltage $v_P$ can be obtained by the following equations 4:

$$i_{L2}(t) = \frac{V_S}{2\sqrt{L_2/C_P}}\sin\omega(t - t_4) \quad (4)$$

$$v_P(t) = \frac{V_S}{2}(1 - \cos\omega(t - t_4))$$

In mode 5, the panel voltage $v_P$ decreases from 0 to −VS, and the voltage across the switching element XL increases from 0 to +VS. The peak current of the panel, IP, PK is limited to VS/(2Zr). Mode 5 is finished when iL2 =0 at $t=t_5$. The period of mode 5, $T_{rX}$, can be calculated by the following equation 5:

$$T_{rX} = T_{rY} = \frac{\pi}{\omega} = \pi\sqrt{L_1 C_P} \quad (5)$$

mode 6 ($t_5 \leqq t < t_6$; gas-discharge mode). (6)

Figure 5F:
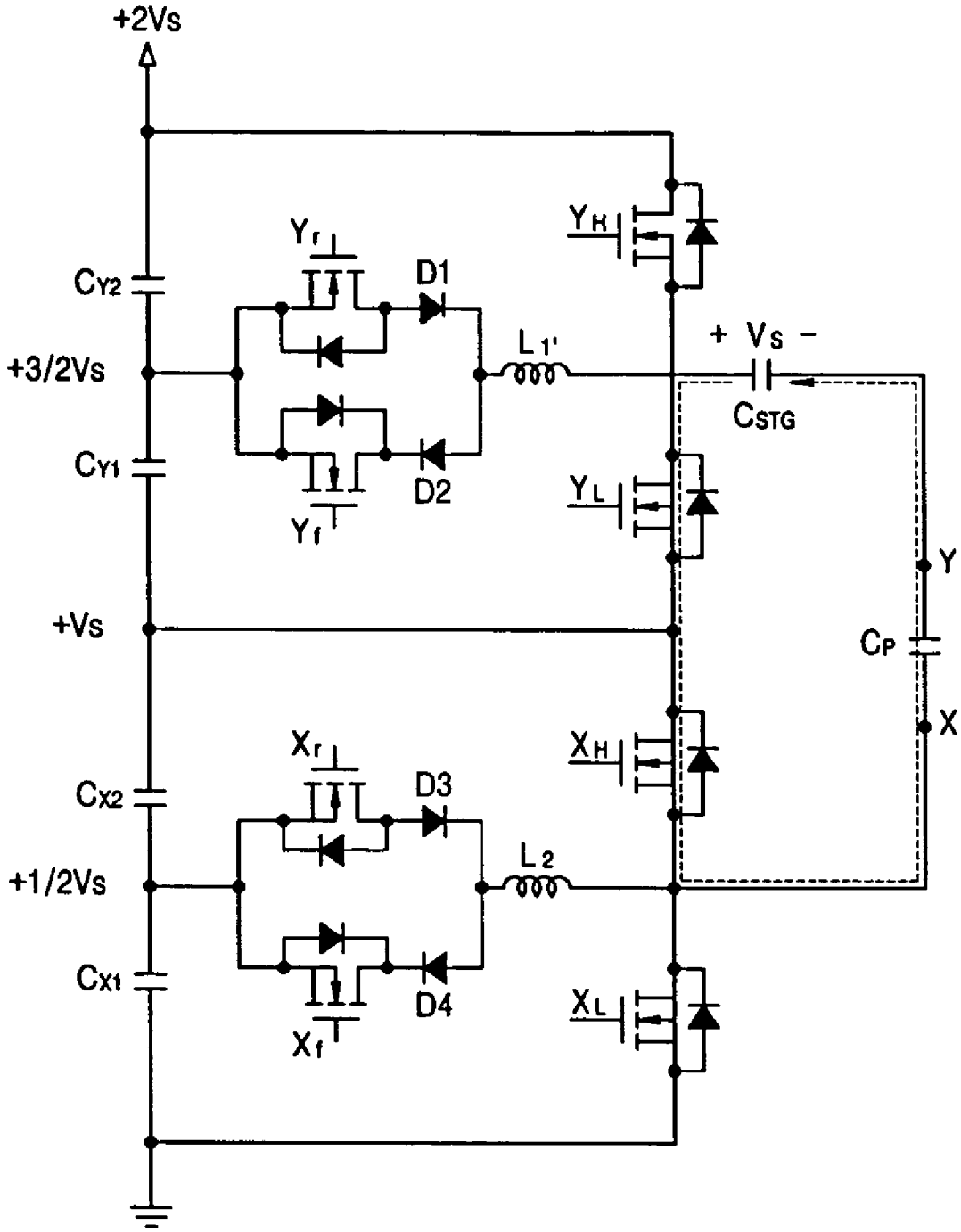

Switching elements $Y_L$ and $X_H$ are turned on at $t=t_5$. The voltage across the switching elements $Y_L$ and $X_H$ is limited to $+V_S$. In mode 6, as shown in FIG. 5F, the panel voltage $v_P$ stays at $-V_S$.

mode 7 ($t_6 \leqq t < t_7$; post-discharge mode). (7)

Figure 5G:
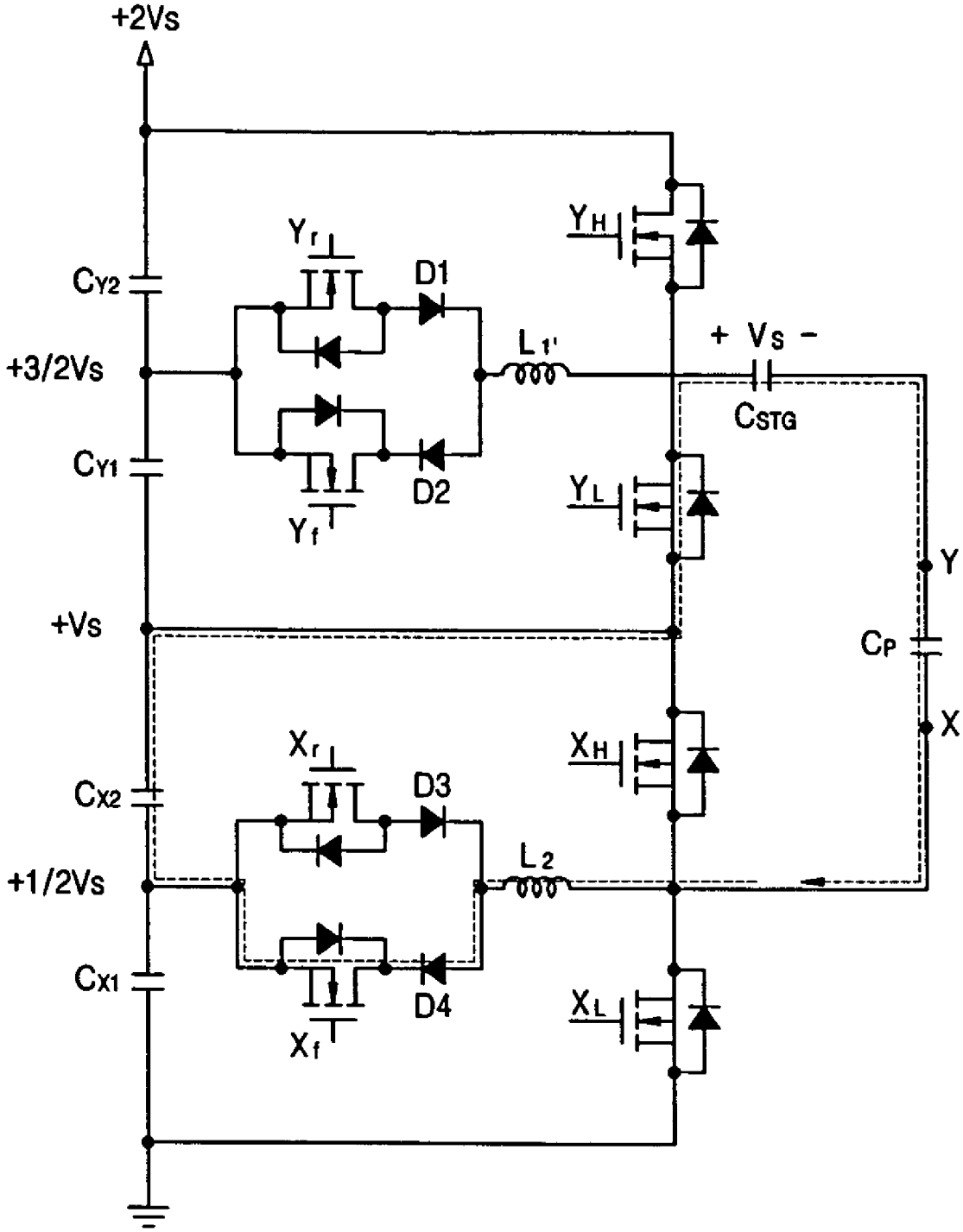

Mode 7 begins with the turning-on of the switching element $X_f$ while the switching element $Y_L$ is turned on. Energy charged in the panel capacitor $C_P$ is fully recovered at the capacitor $C_{X1}$ through a resonant path $C_{X2}$-$Y_L$-$C_{STG}$-$C_P$-$L_2$-$D_4$-$X_f$, as shown in FIG. 5G. Current iL2 and the panel voltage $v_P$ can be calculated by the following equations 6:

$$i_{L2}(t) = \frac{V_S}{2\sqrt{L_2/C_P}}\sin\omega(t - t_6) \quad (6)$$

$$v_P(t) = \frac{V_S}{2}(1 - \cos\omega(t - t_6))$$

The panel voltage $v_P$ increases from $-V_S$ to 0, and the peak current of the panel, $I_{P,\ PK}$ is limited to $V_S/(2Z_r)$. Mode 7 is finished when $i_{L1}=0$ at $t=t_7$. The period of mode 7, $T_{f1}$, is equal to the period of mode 5.

mode 8 ($t_7 \leqq t < t_8$; ground mode). (8)

Figure 5H:
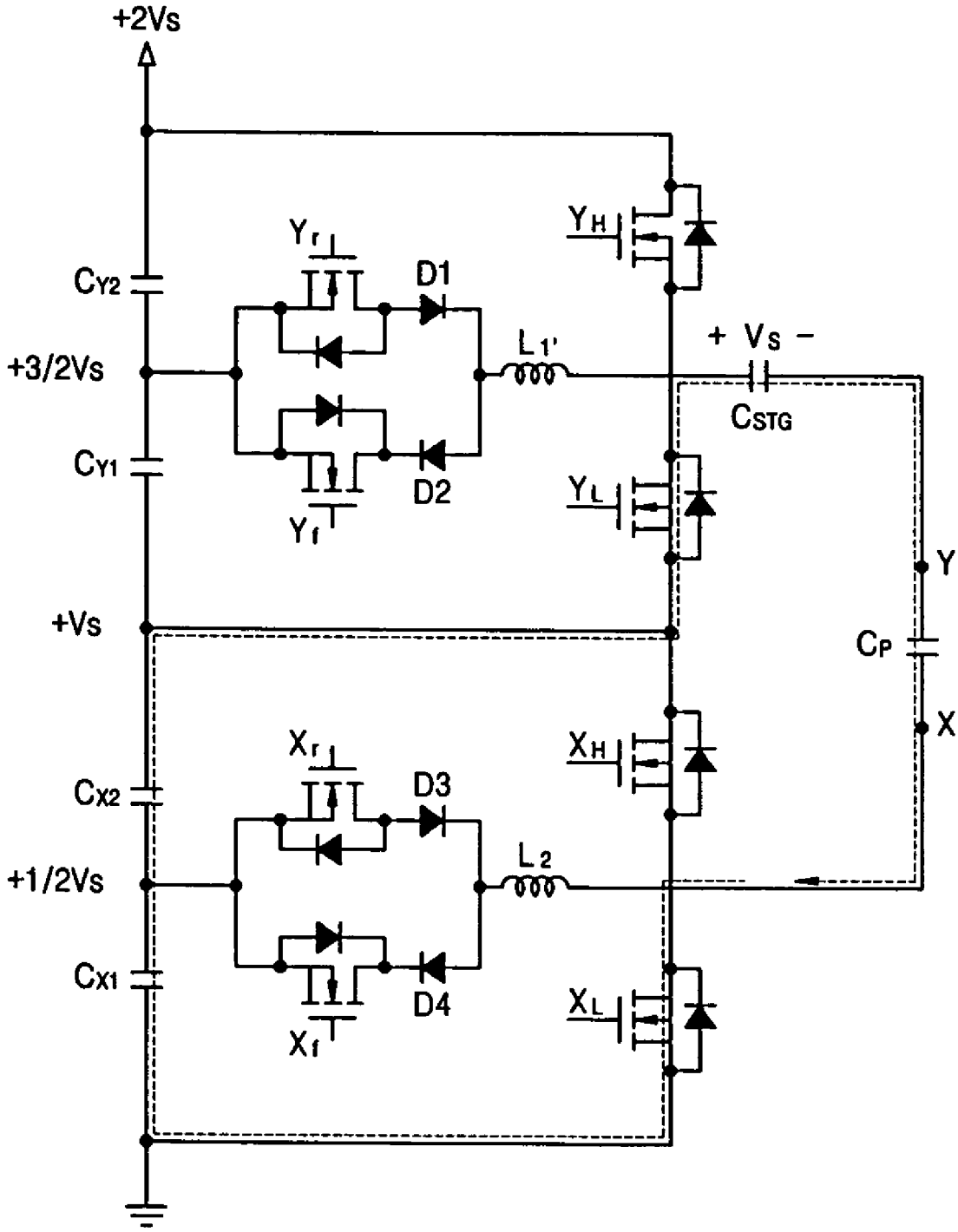

As shown in FIG. 5H, the switching element $X_L$ is turned on by switching with a zero-voltage, and the panel voltage $v_P$ stays at "0" during mode 8.

Figure 6:
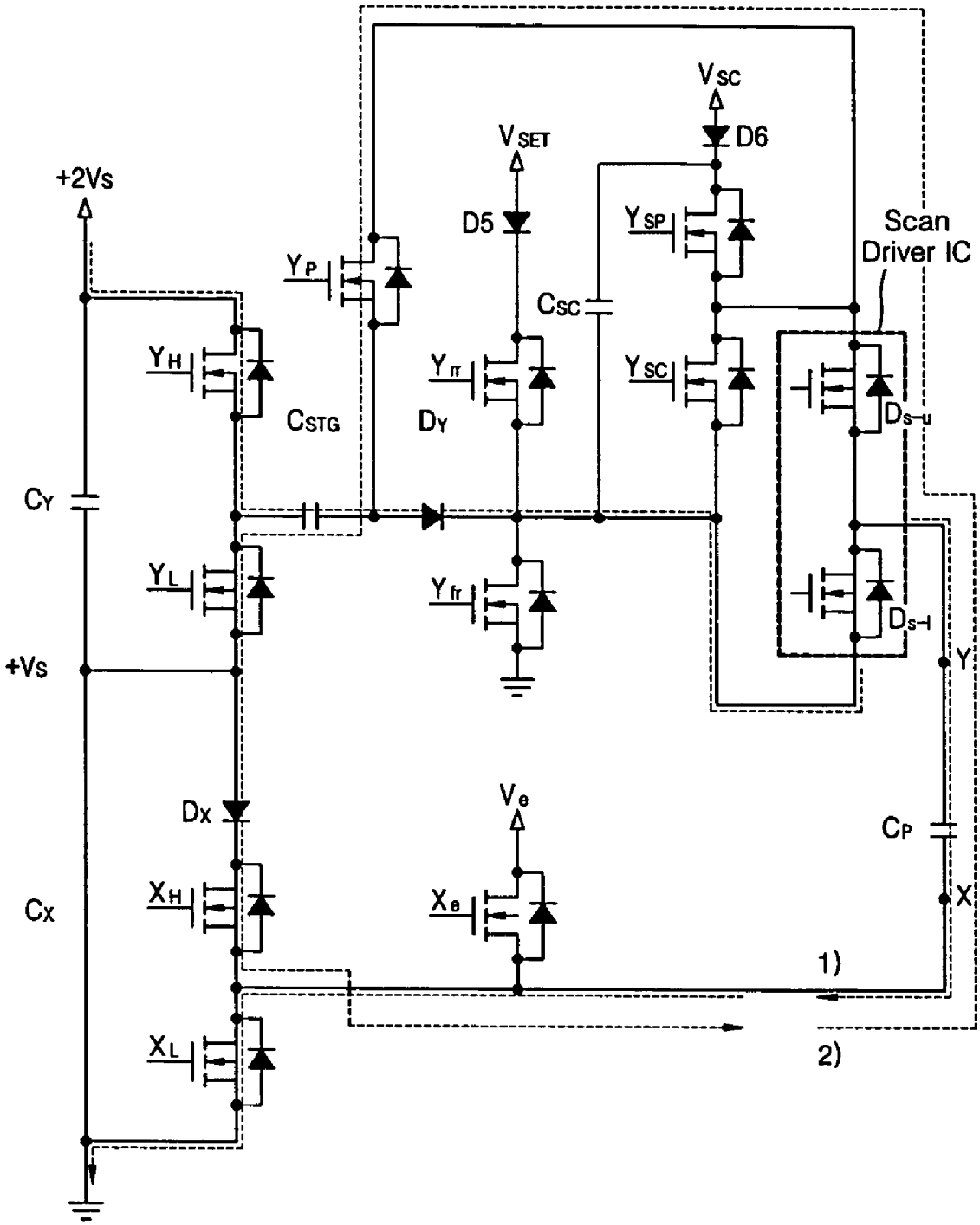
FIG. 6 shows a current flow path to explain a voltage stress on a scan driver IC during a sustain discharge period according to the present invention.

FIG. 6 is a circuit diagram of the single-sided driver of FIG. 3, where a portion involved in the energy recovery is deleted for convenience of circuit analysis during the reset period and the address period.

A path 1) shows a current flow to charge the Y-axis electrode of the panel capacitor during the sustain discharge period. Since the current flows through a body diode $D_{s-1}$ connected to a lower one of two MOSFETs of the scan driver IC, the voltage stress across the scan driver IC is identical to that of the conventional scan driver IC.

A path 2) shows a current flow to discharge the Y-axis electrode of the panel. Since the current flows through a body diode $D_{s-u}$ connected to an upper one of the two MOSFETs of the scan driver IC, the voltage stress across the scan driver IC is identical to that of the conventional circuit (scan driver IC).

The reset period will now be described as follows.

(1) X-rising reset mode.

Figure 7A:
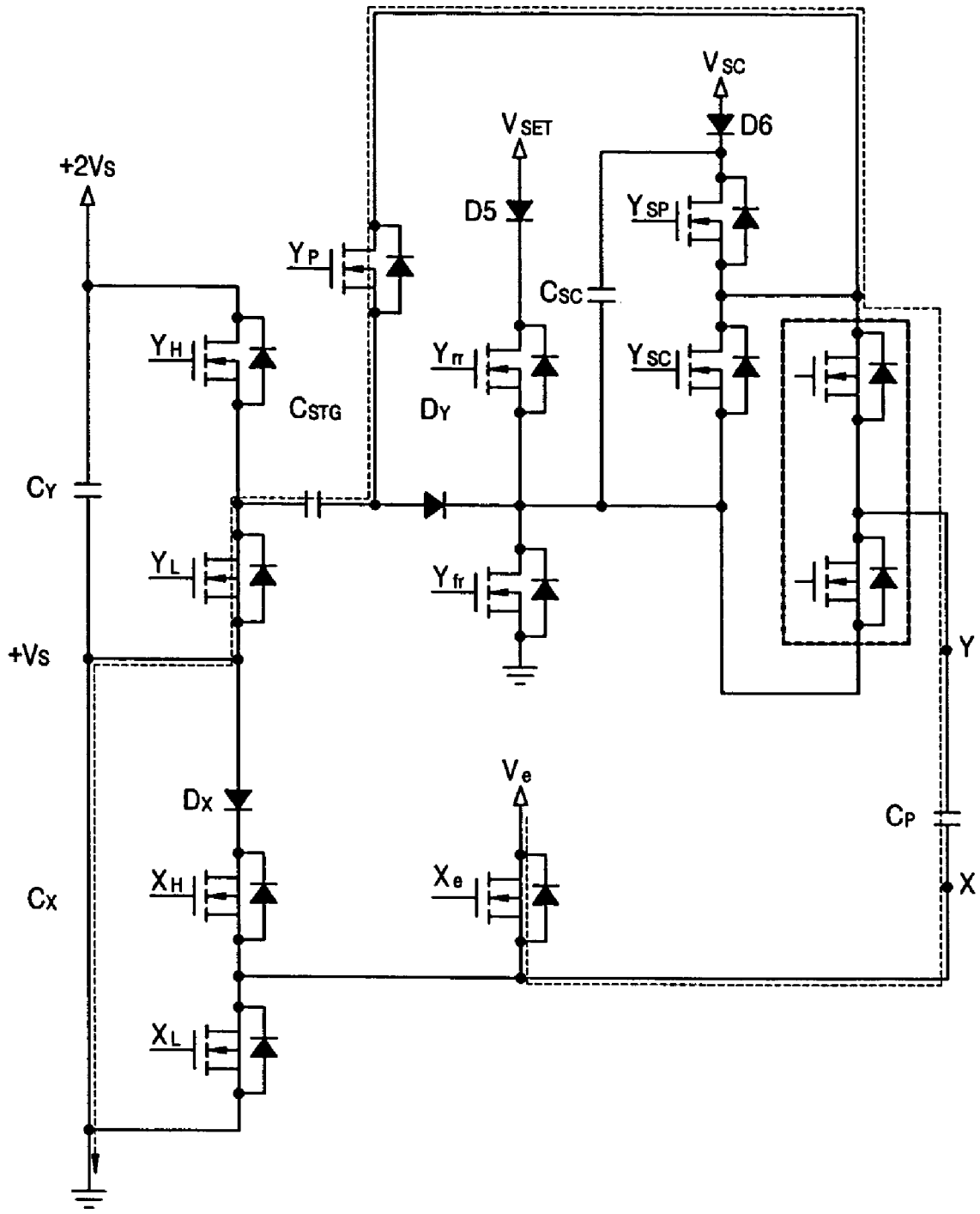
FIG. 7A shows a current flow path in an X-rising reset mode.

In X-rising reset mode, as shown in FIG. 7A, the Y-axis electrode is grounded by turning on the switching element $Y_L$, and then a voltage which linearly rises up to $V_e$ with a simple integrator using the Miller effect is supplied to a gate of the switching element $X_e$. The voltage at the X axis electrode linearly increases, and this X-rising reset mode comes to an end when the voltage at the X axis reaches $V_e$.

(2) Y-rising reset mode.

Figure 7B:
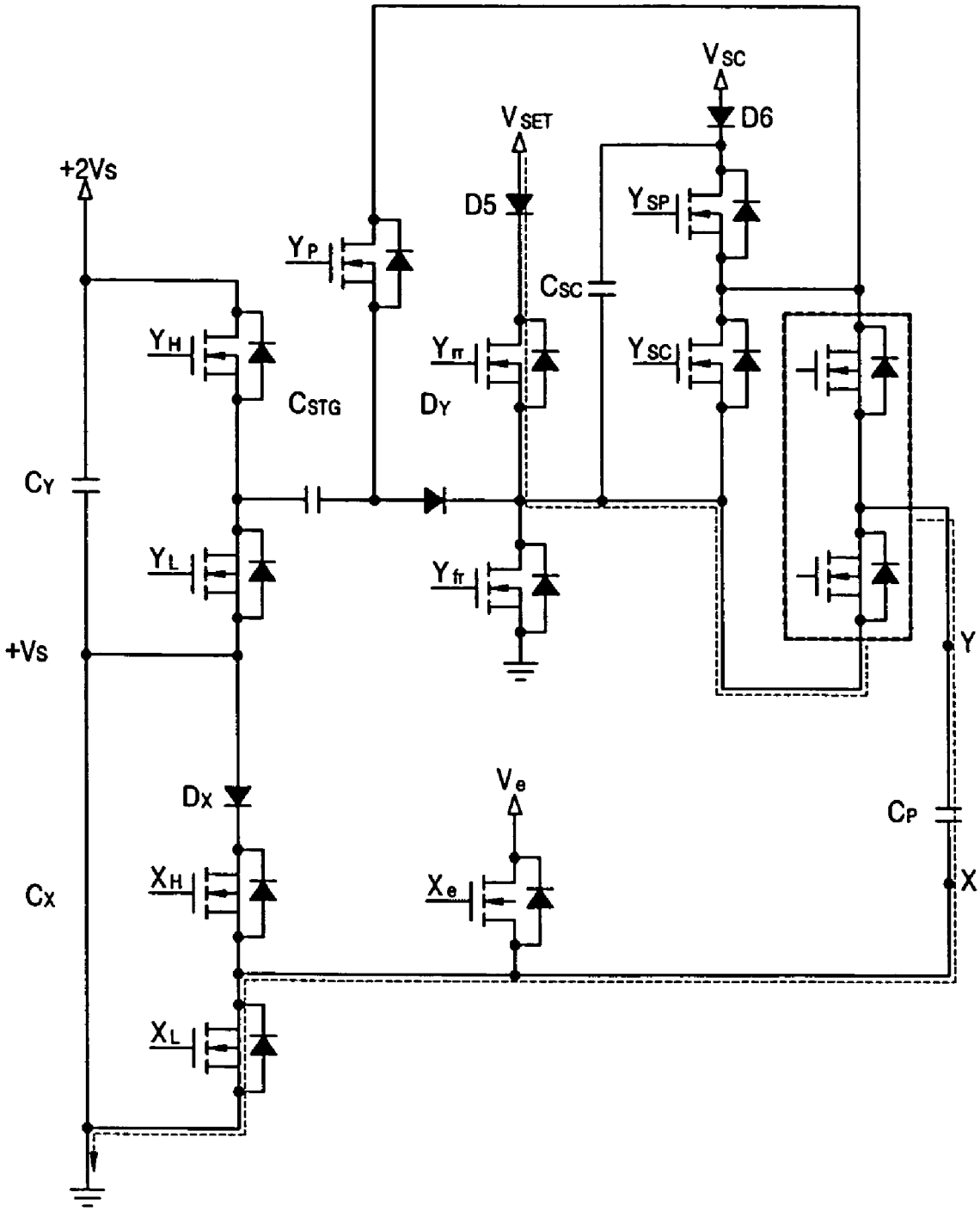
FIG. 7B shows a current flow path in a Y-rising reset mode.

In Y-rising reset mode, as shown in FIG. 7B, the voltage $+V_S$ is supplied to the Y-axis electrode by turning on the switching elements $Y_H$ and $X_L$, and then a rising ramp voltage is supplied to the Y-axis electrode by driving the switching element $Y_{rr}$. At this time, the rising ramp voltage at the Y-axis electrode rises up to $+V_{SET}$ by supplying a linear ramp voltage using the Miller effect to the gate of the switching element $Y_{rr}$.

(3) X-erase reset mode.

Figure 7C:
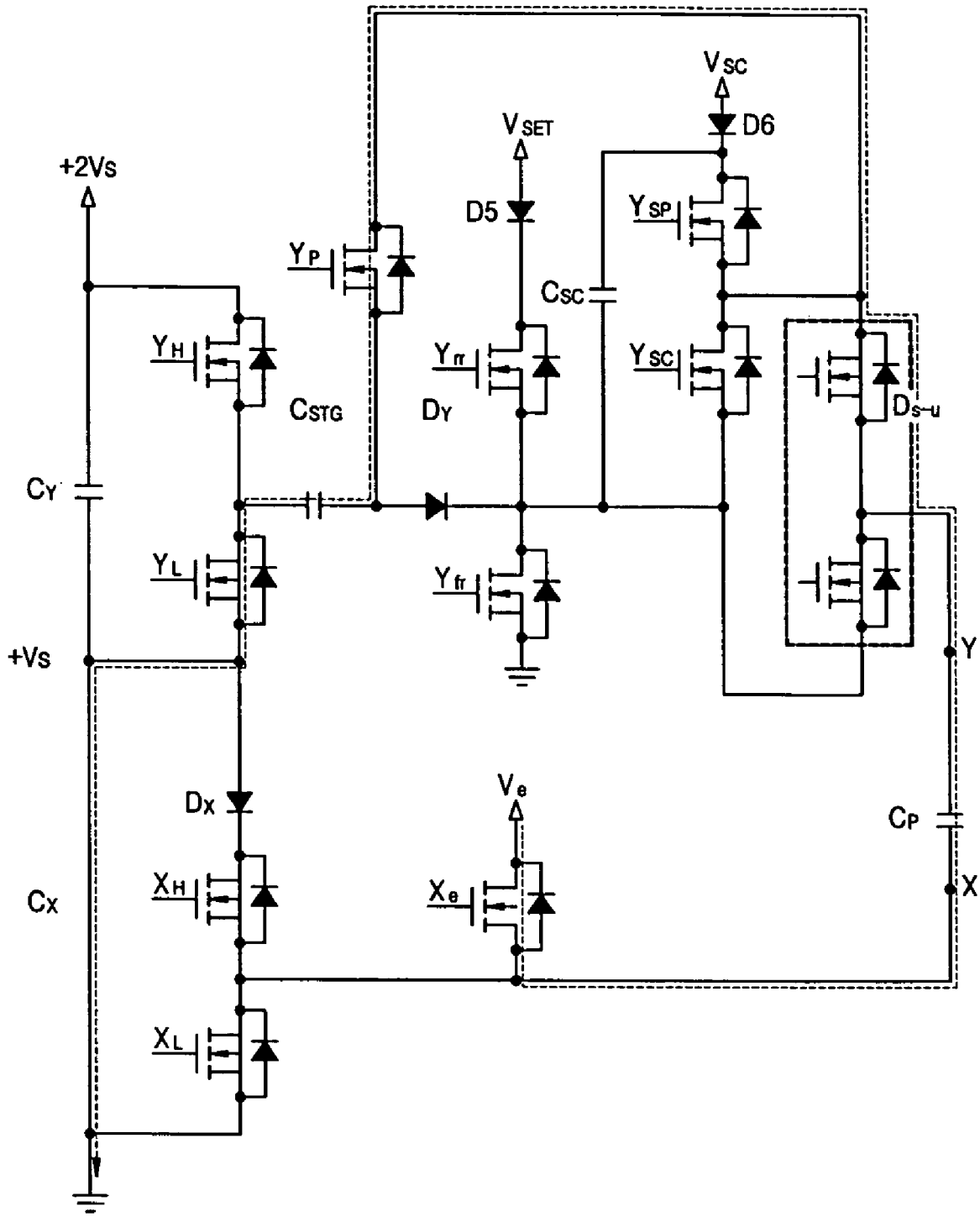
FIG. 7C shows a current flow path in an X-erase reset mode.

In X-erase reset mode, as shown in FIG. 7C, X-erase (that is, erasing wall-charges at the X-axis electrode) is enacted by supplying $V_e$ voltage to the X-axis electrode when the switching element $X_e$ is turned on. At this time, however, overcurrent may flow through a body diode connected to the switching element $X_H$, and therefore a diode $D_X$ is used to prevent the overcurrent.

(4) Y-falling reset mode.

Figure 7D:
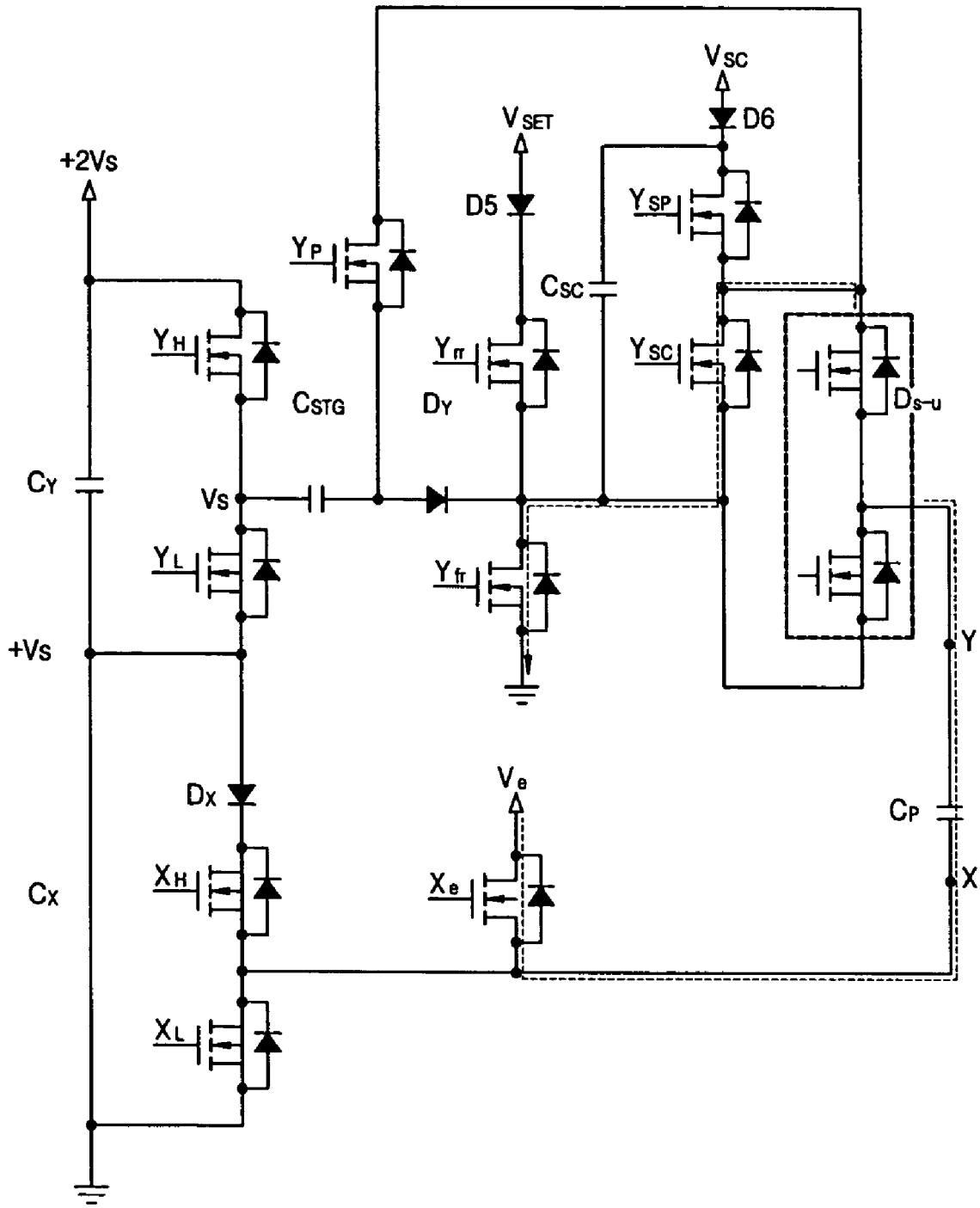
FIG. 7D shows a current flow path in a Y-falling reset mode.

In Y-falling reset mode, as shown in FIG. 7D, switching elements $Y_H$ and $Y_P$ are turned on. The panel voltage $v_P$ is clamped into $+V_S$ through a body diode $D_{s-u}$ via the switching element $Y_P$. Then, switching elements $Y_H$ and $Y_P$ are turned off and switching elements $Y_{SC}$ and $Y_{fr}$ are turned on. At this time, the voltage at the Y-axis electrode drops to the ground level.

Finally, the address period will now be described.

Figure 8:
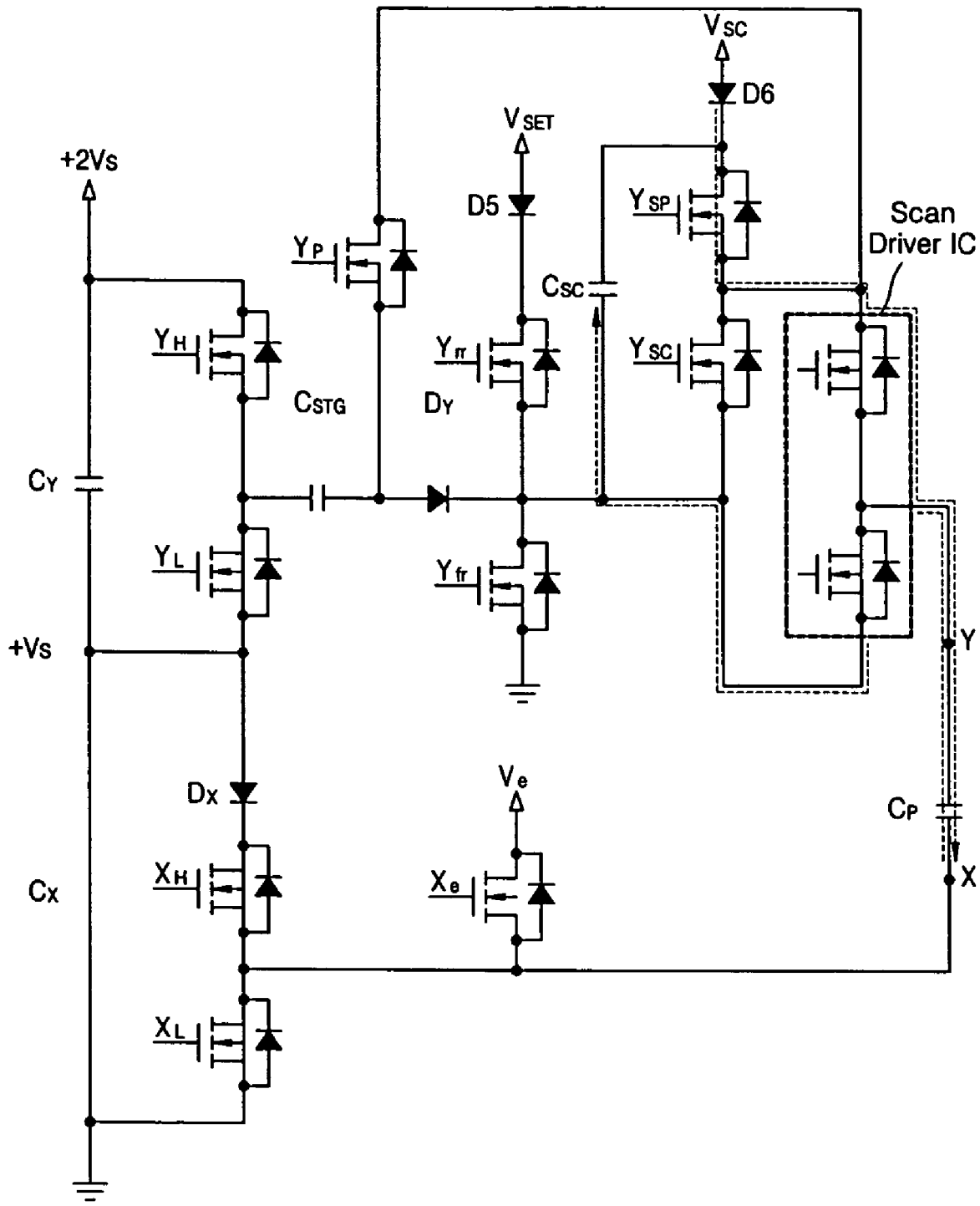
FIG. 8 shows a current flow path during an address discharge period.

As shown in FIG. 8, when the voltage at the Y-axis electrode drops to the ground level, a capacitor $C_{SC}$ is charged with voltage $V_{SC}$, by which the scan driver IC is driven. When a voltage $V_{SC}$ is supplied to the scan driver IC by turning on the switching element $Y_{SP}$, the address discharging for each line occurs. At this time, the switching element $Y_L$ is turned on and the voltage at the Y-axis electrode basically stays at the ground level, and the switching element $X_e$ is turned on and the voltage at the X-axis electrode stays at $V_e$.

As described above, the single-sided display panel driver shown in FIG. 3 separately generates voltages that are required for the X and Y axes electrodes during the sustain discharge period, the address period and the reset period, according to switching sequences to drive the display panel. The circuit structure of the single-sided display panel driver is simpler than the conventional art, with a reduced number of parts, and has enhanced reliability and energy efficiency.

The present invention can be realized as a method, an apparatus, and a system. When the present invention is manifested in computer software, components of the present invention may be replaced with code segments that are necessary to perform the required action. Programs or code segments may be stored in media readable by a processor, and transmitted as computer data that is combined with carrier waves via a transmission media or a communication network. The media readable by a processor include anything that can store and transmit information, such as, electronic circuits, semiconductor memory devices, ROM, flash memory, EEPROM, floppy discs, optical discs, hard discs, optical fiber, radio frequency (RF) networks, etc. The computer data also includes any data that can be transmitted via an electric network channel, optical fiber, air, electromagnetic field, RF network, etc.

Although the present invention has been shown and described with reference to preferred embodiments thereof, it will be appreciated by those skilled in the art that various changes may be made to the preferred embodiments without departing from the spirit and scope of the invention as defined by the appended claims and their equivalents.

What is claimed is:

1. A single-sided driver used with a display panel, the single-sided driver comprising:

a single-sided driver circuit having separate current flow paths coupled to each of X and Y axes electrodes of the display panel, the single-sided driver circuit having predetermined circuit elements including energy accumulation elements and switching elements, and establishes current in the current flow paths to generate respective predetermined driving voltage waveforms on the X and Y axes electrodes according to predetermined switching sequences to drive the display panel, wherein the single-sided driver circuit comprising:

an isolation and reset circuit combination which isolates an energy recovery path and establishes a current flow path to generate reset voltage waveforms that are supplied to both the X and Y axes electrodes to eliminate wall charges in the display panel during a reset period;

a scan pulse generation circuit which establishes a current flow path to generate address discharging voltage waveforms to be supplied to the X and Y axes electrodes to generate wall charges in the display panel during an address period; and a sustain driver circuit which establishes charging/discharging paths to charge/discharge the display panel according to the predetermined switching sequences to drive the display panel during a sustain discharge period, and establishes a current flow path to generate the reset voltage waveform and the address discharging voltage waveforms during the reset period and the address period, respectively, in combination with the isolation and reset circuit and the scan pulse generation circuit.

2. The driver of claim 1, wherein the single-sided driver circuit repeatedly supplies zero voltage and +/− multi-level voltages that are symmetric with respect to the zero voltage across the X and Y axes electrodes of the display panel during a sustain discharge period.

3. The driver of claim 1, wherein a source voltage to be supplied to the single-sided driver circuit is set to be twice as much as a voltage that is supplied to the display panel during a gas discharge mode in the sustain discharge period.

4. The driver of claim 1, wherein the sustain driver circuit comprises a capacitor with greater capacitance than the display panel on the charging/discharging path.

5. The driver of claim 4, wherein the capacitor is set to be charged with a voltage supplied to the display panel during a gas discharge mode in the sustain discharge period.

6. The driver of claim 1, wherein the sustain driver circuit further comprises an energy recovery circuit which recovers energy discharged from the display panel by way of an LC resonant circuit and dispatches the recovered energy back to the display panel.

7. The driver of claim 1, wherein the sustain driver circuit is designed to have a capacitor clamp-type multi-level converting circuit structure.

8. The driver of claim 7, wherein the capacitor clamp-type multi-level converting circuit structure is designed by:

connecting a plurality of capacitors in series;

connecting one end of the series of the capacitors to ground and supplying a source voltage to the other end of the series of capacitors; and connecting switching elements to connection nodes of the capacitors, wherein the structure enables zero voltage and +/− multi-level voltages that are systematic with respect to the zero voltage to be repeatedly supplied to the display panel during the sustain discharge period by changing current flow paths according to the predetermined switching sequences to drive the display panel.

9. The driver of claim 1, wherein the sustain driver circuit comprises:

a block of energy accumulation elements in which first, second, third, and fourth capacitors are connected in series, a first end of the series is connected to a ground, and the other end of the series is connected to a source voltage of the sustain driver circuit;

first and second inductors used to accumulate energy discharged from the X and Y axes electrodes of the display panel in combination with the block of energy accumulation elements;

a first switching block connected between a connection node of the first and second capacitors and the second inductor to drive current to flow along an LC resonant circuit path via the second inductor during the charge/discharge mode for the X-axis electrode of the display panel;

a second switching block connected between a connection node of the third and fourth capacitors and the first inductor to drive current to flow along an LC resonant circuit path via the first inductor during the charge/discharge mode for the Y-axis electrode of the display panel;

a third switching block to establish a current flow path to separately generate predetermined voltage waveforms that are required for the X and Y axes electrodes of the display panel according to the predetermined switching sequences to drive the display panel by connecting a first and a second switching element and a third and a fourth switching element in series, respectively, locating a first diode between the second and third switching elements, connecting a free end of the first switching element to ground, and connecting a free end of the fourth switching element to the source voltage for the sustain driver circuit, connecting a connection node of the first and second switching elements to the second inductor and the X-axis electrode of the display panel, connecting a connection node of the third and fourth switching elements to the first inductor, and connecting a connection node of the second and third capacitors to a connection node of the diode between the second and third switching elements and the third switching element; and a capacitor is located between the connection node of the third and fourth switching elements and the isolation and reset circuit.

10. The driver of claim 9, wherein the first switching block comprises a plurality of switching elements and a plurality of diodes.

11. The driver of claim 9, wherein the second switching bock comprises a plurality of switching elements and a plurality of diodes.

12. The driver of claim 1, wherein the isolation and reset circuit combination comprises:

an isolation circuit including a second diode and a fifth switching element connected between the sustain driver circuit and the scan pulse generation circuit, so as to isolate the scan pulse generation circuit from the energy recovery circuit included in the sustain driver circuit during the reset period, according to a predetermined reset switching sequence; and a reset circuit used to separately generate reset voltage waveforms for the X and Y axes electrodes according to the predetermined switching sequences to drive the display panel by connecting a sixth switching element between a connection node of the scan pulse generation circuit and the isolation circuit, and the ground, connecting a third diode and a seventh switching element in series between the connection node of the scan pulse generation circuit and the isolation circuit and a first reset source voltage, and connecting an eighth switching element between the X-axis electrode and a second reset source voltage.

13. A method of designing a single-sided driver circuit to drive a display panel, the method comprising:

selecting circuit elements including energy accumulation elements and switching elements that establish current flow paths to generate respective predetermined driver voltage waveforms at X and Y axes electrodes according to predetermined switching sequences so that a resulting voltage across the X and Y electrodes alternates in polarity with respect to a reference voltage to drive the display panel;

selecting circuit elements for an isolation and reset circuit combination which isolates an energy recovery path and establishes a current flow path to generate reset voltage waveforms that are supplied to both the X and Y axes electrodes to eliminate wall charges in the display panel during a reset period;

selecting circuit elements for a scan pulse generation circuit which establishes a current flow path to generate address discharging voltage waveforms to be supplied to the X and Y axes electrodes to generate wall charges in the display panel during an address period; and selecting circuit elements for a sustain driver circuit which establishes charging/discharging paths to charge/discharge the display panel according to the predetermined switching sequences to drive the display panel during a sustain discharge period, and establishes a current flow path to generate the reset voltage waveform and the address discharging voltage waveforms during the reset period and the address period, respectively, in combination with the isolation and reset circuit and the scan pulse generation circuit; and constructing the single-sided driver circuit to include the circuit elements.

14. The method of claim 13, wherein the circuit elements are arranged to supply zero voltage and +/− multi-level voltages that are symmetric with respect to the zero voltage to the display panel during the sustain discharge period, in the predetermined switching sequences to drive the display panel.

15. The method of claim 13, wherein a voltage to be supplied to the single-sided driver circuit is set to be twice as much as a voltage to be supplied to the display panel during a gas discharging mode in the sustain discharge period.

16. The method of claim 13, wherein the single-sided driver circuit is designed to have a capacitor clamp-type multi-level converting circuit structure.

17. The method of claim 16, wherein the capacitor clamp-type multi-level converting circuit structure is designed by:

connecting a plurality of capacitors in series;

connecting the series of the capacitors between ground and a source voltage to be supplied to a sustain driver circuit;

connecting each of connection nodes of the capacitors to each of switching elements; and repeatedly supplying zero voltage, and +/− multi-level voltages that are symmetric with respect to the zero voltage, to the display panel during the sustain discharge period, by changing current flow paths according to the predetermined switching sequences to drive the display panel.

18. A single-sided driver circuit to drive X and Y electrodes of a display panel, comprising:

an isolation and reset circuit combination to establish a current flow path to generate reset ramp voltage waveforms for the X and Y axes electrodes to eliminate wall charges on the display panel while cutting off the energy recovery path during a reset period;

a scan pulse generation circuit connected with the isolation and reset circuit combination and the X and Y axes electrodes to establish a current flow path to generate voltage waveforms for the X and Y axes electrodes to make wall charges on the display panel during an address period; and a sustain driver circuit connected with the isolation and reset circuit combination and the X and Y axes electrodes to establish charging/discharging paths to charge/discharge the display panel according to predetermined switching sequences to drive the display panel during the sustain discharge period, and to establish predetermined current flow paths to generate a reset voltage waveform and an address discharge voltage waveform in combination with the reset circuit and the scan pulse generation circuit, respectively, during the reset period and the address period.

19. The single-sided driver circuit of claim 18, wherein the sustain driver circuit comprises:

first, second, third and fourth capacitors connected in series, one end of the series being connected to a ground and another end of the series being connected to a source voltage;

first, second, third and fourth switching elements connected in series, one end of the series being connected to the ground and another end being connected to the source voltage;

a first switching block and first inductor combination being connected at one end to a node connecting the first and second capacitors and at another end to a node connecting the first and second switching elements;

a second switching block and second inductor combination being connected at one end to a node connecting the third and fourth capacitors and at another end to a node connecting the third and fourth switching elements; and a fifth capacitor connected at one end to the node connecting the third and fourth switching elements and the isolation and reset circuit combination.

20. The single-sided driver circuit of claim 18, wherein the isolation and reset circuit combination comprises:

an isolation circuit including a diode and a fifth switching element connected between the sustain driver circuit and the scan pulse generation circuit to isolate the scan pulse generation circuit during the reset period according to a predetermined reset switching sequence; and a reset circuit to separately generate reset voltage waveforms for the X and Y axes electrodes according to the predetermined switching sequences to drive the display panel by connecting a sixth switching element between a connection node of the scan pulse generation circuit and the isolation circuit, and the ground, connecting a third diode and a seventh switching element in series between the connection node of the scan pulse generation circuit and the isolation circuit and a first reset source voltage, and connecting an eighth switching element between the X-axis electrode and a second reset source voltage.

21. A computer readable medium including computer instructions encoded thereon to perform a method of providing respective driving voltages to X and Y axes electrodes of a display panel, the method comprising:

establishing a current flow path to generate reset ramp voltage waveforms for the X and Y axes electrodes to reduce wall charges on the display panel while cutting off the energy recovery path during a reset period;

establishing a current flow path to generate voltage waveforms for the X and Y axes electrodes to make wall charges on the display panel during an address period;

switching current between current flow paths to generate predetermined driving voltage waveforms alternating in polarity with respect to a reference voltage across X and Y axes electrodes according to predetermined switching sequences to drive the display panel during a sustain discharge period; and establishing predetermined current flow paths to generate a reset voltage waveform and an address discharge voltage waveform during the reset period and the address period.

22. The computer readable medium of claim 21, further comprising instructions to perform the method of repeatedly supplying zero voltage and +/− multi-level voltages that are symmetric with respect to the zero voltage across the X and Y axes electrodes of the display panel during the sustain discharge period.

23. A display panel driver circuit comprising:

an isolation and reset circuit combination to establish a current flow path to generate reset ramp voltage waveforms for a first electrode and a second electrode during a reset period;

a scan pulse generation circuit connected with the isolation and reset circuit combination and the first and second electrodes to establish a current flow path to generate voltage waveforms during an address period;

a first sustain driver circuit to provide a first current to the first electrode of a display panel; and a second sustain driver circuit connected electrically in series with the first sustain driver circuit to provide a second current to the second electrode of the display panel, the first current and the second current producing a time-varying voltage across the first electrode and the second electrode.

24. The display panel driver circuit of claim 23, wherein the time-varying voltage across the first electrode and the second electrode alternates in polarity with respect to a reference voltage in adjacent time periods.

25. A display panel driver circuit comprising:

a gas discharge cell having a first axis electrode and a second axis electrode;

a first current path coupled to the first axis electrode;

a second current path coupled to the second axis electrode;

an isolation and reset circuit combination to establish a current flow path to generate reset ramp voltage waveforms for the first axis electrode and the second axis electrode during a reset period;

a scan pulse generation circuit connected with the isolation and reset circuit combination and the first and second axis electrodes to establish a current flow path to generate voltage waveforms during an address period; and a switching circuit to control a current in energy accumulation elements in the first current path and the second current path to produce in temporally adjacent gas discharge periods a voltage between the first axis electrode and the second axis electrode that alternates in polarity with respect to a reference voltage.

* * * * *

UNITED STATES PATENT AND TRADEMARK OFFICE

CERTIFICATE OF CORRECTION

PATENT NO. : 7,629,949 B2
APPLICATION NO. : 10/826278
DATED : December 8, 2009
INVENTOR(S) : Joon-hyun Yang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1288 days.

Signed and Sealed this

Twenty-first Day of December, 2010

David J. Kappos

David J. Kappos
*Director of the United States Patent and Trademark Office*